US009522768B2

(12) United States Patent
Wilcoxen et al.

(10) Patent No.: US 9,522,768 B2
(45) Date of Patent: Dec. 20, 2016

(54) DRAW TAPE BAG

(71) Applicant: The Glad Products Company, Oakland, CA (US)

(72) Inventors: Kyle R. Wilcoxen, Chicago, IL (US); Robert W. Fraser, Lombard, IL (US)

(73) Assignee: The Glad Products, Oakland, CA (US)

( * ) Notice: Subject to any disclaimer, the term of this patent is extended or adjusted under 35 U.S.C. 154(b) by 237 days.

(21) Appl. No.: 13/692,667

(22) Filed: Dec. 3, 2012

(65) Prior Publication Data

US 2013/0094788 A1 Apr. 18, 2013

Related U.S. Application Data

(63) Continuation-in-part of application No. 12/869,608, filed on Aug. 26, 2010, now Pat. No. 8,794,835.

(60) Provisional application No. 61/239,469, filed on Sep. 3, 2009.

(51) Int. Cl.

| | |
|---|---|
| ***B65D 33/28*** | (2006.01) |
| ***B65D 30/08*** | (2006.01) |
| ***B65F 1/00*** | (2006.01) |

(52) U.S. Cl.

CPC ..... *B65D 33/28* (2013.01); *B65D 31/02* (2013.01); *B65F 1/002* (2013.01); *B65F 1/0006* (2013.01); *Y10T 428/2457* (2015.01)

(58) Field of Classification Search

CPC ..... B65D 29/02; B65D 31/00; B65D 31/02; B65D 31/10; B65D 31/16; B65D 33/02; B65D 88/1631; B65D 88/1625; B65D 2588/165; B65D 33/165; B65D 33/1616; B65D 33/28; B65D 29/04; B31B 19/90; B31B 2219/90; B31B 2219/9029; B31B 2219/9035; B65F 1/0006; B65F 1/002; Y10T 428/2457

USPC ..... 383/105, 112, 118, 119, 71–76

See application file for complete search history.

(56) References Cited

U.S. PATENT DOCUMENTS

| | | | | | |
|---|---|---|---|---|---|
| 1,962,071 | A | * | 6/1934 | Greene | 383/118 |
| 2,750,631 | A | * | 6/1956 | Johnson | 264/519 |
| 3,684,642 | A | * | 8/1972 | Rogers, Jr. | 428/182 |
| 3,984,047 | A | * | 10/1976 | Clayton et al. | 383/119 |
| 4,015,635 | A | * | 4/1977 | Goransson | 138/119 |
| 4,076,121 | A | * | 2/1978 | Clayton et al. | 206/390 |
| 4,153,664 | A | | 5/1979 | Sabee | |
| 4,315,963 | A | | 2/1982 | Havens | |
| 4,374,690 | A | | 2/1983 | Canterino et al. | |
| 5,133,607 | A | | 7/1992 | Bonke | |
| 5,205,650 | A | | 4/1993 | Rasmussen | |
| 5,390,875 | A | | 2/1995 | Gietman et al. | |
| 5,518,801 | A | | 5/1996 | Chappell et al. | |
| 5,618,111 | A | | 4/1997 | Porchia et al. | |
| 5,650,214 | A | * | 7/1997 | Anderson et al. | 428/152 |
| 6,059,458 | A | | 5/2000 | Belias et al. | |
| 6,150,647 | A | * | 11/2000 | Anderson et al. | 219/730 |
| 6,402,377 | B1 | | 6/2002 | Vo et al. | |

(Continued)

FOREIGN PATENT DOCUMENTS

WO WO2007/146877 12/2007

*Primary Examiner* — Peter Helvey
(74) *Attorney, Agent, or Firm* — Thomas C. Feix

(57) ABSTRACT

A plastic bag may include flexible thermoplastic sidewalls that have a pattern of ribs alternating between thinner areas. The ribs may also be alternating between two types of ribs having different lengths and shapes. The bag may also include a network pattern above the pattern of ribs.

19 Claims, 14 Drawing Sheets

(56) References Cited

U.S. PATENT DOCUMENTS

| | | | | |
|---|---|---|---|---|
| 6,513,975 | B1 | 2/2003 | Jackson et al. | |
| 6,605,172 | B1 | 8/2003 | Anderson et al. | |
| 6,695,476 | B2 * | 2/2004 | Jackson et al. | 383/77 |
| 6,939,042 | B2 | 9/2005 | Rusnak | |
| 6,966,697 | B2 | 11/2005 | Patridge et al. | |
| 7,132,151 | B2 | 11/2006 | Rasmussen | |
| 7,300,395 | B2 | 11/2007 | Sleight et al. | |
| 8,557,364 | B2 | 10/2013 | Rasmussen | |
| 8,794,835 | B2 * | 8/2014 | Wilcoxen et al. | 383/118 |
| 2001/0022865 | A1 * | 9/2001 | Meyer et al. | 383/118 |
| 2002/0105110 | A1 | 8/2002 | Dorbin et al. | |
| 2002/0126919 | A1 | 9/2002 | Jackson et al. | |
| 2008/0137995 | A1 | 6/2008 | Fraser et al. | |
| 2009/0233041 | A1 * | 9/2009 | Rasmussen | 428/101 |
| 2010/0046860 | A1 | 2/2010 | Kent et al. | |
| 2010/0098354 | A1 | 4/2010 | Fraser et al. | |
| 2011/0052104 | A1 | 3/2011 | Wilcoxen et al. | |
| 2011/0052105 | A1 | 3/2011 | Wilcoxen et al. | |
| 2012/0134606 | A1 | 5/2012 | Borchardt et al. | |

* cited by examiner

DRAW TAPE BAG

CROSS-REFERENCE TO RELATED APPLICATIONS

The present application is a continuation in part of U.S. patent application Ser. No. 12/869,608 filed Aug. 26, 2010 and entitled DRAW TAPE BAG, which claims the benefit of U.S. Provisional Application No. 61/239,469, filed Sep. 3, 2009. Each of the above-referenced applications is hereby incorporated by reference in its entirety.

BACKGROUND OF THE INVENTION

Field of the Invention

This invention relates generally to bags having a draw tape. More particularly, the present invention relates generally to trash bags having a draw tape.

Description of the Related Art

Among their many applications, it is known to use thermoplastic bags as liners in trash or refuse receptacles. Trash receptacles that employ such liners may be found at many locations, such as, small household kitchen garbage cans. Bags that are intended to be used as liners for such refuse containers are typically made from low-cost, pliable thermoplastic material. When the receptacle is full, the thermoplastic liner actually holding the trash may be removed for further disposal and replaced with a new liner.

It is desirable to reduce the cost of producing the disposable thermoplastic bags as much as possible. Therefore, such bags typically are mass-produced in a high speed manufacturing environment. Other cost savings can be realized by reducing the amount or quality of thermoplastic material utilized to make the bag. However, reducing the amount or quality of thermoplastic material forming the bag limits bag strength and toughness and makes the bag susceptible to tearing or rupture. Accordingly, there is a need for a thermoplastic bag designed in a manner that reduces material cost while maintaining strength and toughness characteristics and facilitating high-speed manufacturing.

BRIEF SUMMARY

The bag may be made from flexible, pliable, low-cost thermoplastic material. The bag may include rectangular first and second sidewalls that may be overlaid and joined to each other along a first side edge, a parallel second side edge and a closed bottom edge to delineate an interior volume. The first and second side edges and closed bottom edge may be formed by sealing the thermoplastic material together. To access the interior volume, the top edges of the sidewalls that are opposite the closed bottom edge may remain unjoined or unsealed to provide an opening.

To provide bags that easily fit into trash canisters and yet are strong and easily removed, the bag may contain both ribbed patterned areas and network patterned areas mixed with un-patterned film areas for optimal functional properties of different sections of the bag. For example, the ribbed patterned areas may provide sufficient physical properties and lower surface contact area at lower film thickness and lower basis weight than the un-patterned film. In another example, the network patterned areas may provide additional stretch or elastic properties and lower surface contact than the un-patterned film. Examples of ribbed patterned areas are described in the specification below. Examples of elastic or strainable network patterned areas are described in U.S. Pat. No. 7,942,577 to Fraser et al. and U.S. Pat. No. 5,518,801 to Chappell et al., both of which are incorporated in their entirety herein. Other examples of network patterned areas that may provide lower surface contact include embossing and other techniques.

In a further embodiment, the bag may be provided with additional features to help retain it to the trash canister. These features may include forming the thermoplastic sidewall material between the opposing sides to have a stretchable or yieldable characteristic or stretchable drawstring, for example as described in U.S. Pat. App. 2010/0046860 and incorporated by reference in its entirety herein. In one embodiment, the sidewall may be formed so that the sheet-like thermoplastic material bunches together as a series of wrinkles or creases. When a pulling force is applied, the bunched together thermoplastic material may un-bunch thereby allowing the bag to stretch or expand. The thermoplastic material may have some shape memory tending to cause the material to re-bunch together, thereby providing an elastic or resilient characteristic to the bag and helping the throat to grip or constrict around the canister. In another embodiment, the bag may have strips of elastic material attached to one or both of the sidewalls and may extend between the converging portions of the first and second side edges. Like the stretchable sidewall material, the strip of elastic material may help grip and retain the bag to the refuse canister.

In one aspect, a thermoplastic bag comprises a first sidewall of flexible thermoplastic material; a second sidewall of flexible thermoplastic material overlaying and joined to the first sidewall to form a first sidewall seam along a first side edge, to form a second sidewall seam along an opposite second side edge, and a closed bottom edge, the first and second sidewalls un-joined along respective top edges to define an opening opposite the bottom edge for accessing the interior volume; at least one of the sidewalls forming a hem having a top length and extending along the open top end disposed opposite the bottom edge, the hem having a bottom length and a hem seal, the hem including one or more draw tape notches and a draw tape within the hem; wherein at least one of the first or second sidewalls includes a first portion with a discontinuous network pattern extending linearly between the first side edge and the second side edge and across the first and second sidewall seams; wherein the portion with the discontinuous network pattern extends from above the bottom edge to below the hem seal such that there is a top un-patterned portion below the hem seal; wherein the bag comprises a second portion with a pattern of adjacent, linear ribs extending linearly between the first side edge and the second side edge and across the first and second sidewall seams, the ribs being substantially parallel; wherein the second portion is below the first portion; wherein the first portion has a first average thickness, the second portion has a second average thickness, the second average thickness is less than the first average thickness; wherein the first portion is a strainable network comprising a first region undergoing substantially molecular-level deformation and a second region undergoing substantially geometric deformation.

A discontinuous or differentiated network patterns of parallel, adjacent ribs, for example a strainable network pattern as described in U.S. Pat. No. 7,942,577 to Fraser et al., may surprisingly allow a higher density thermoplastic to be used in the hem seal of a draw string bag, compared to a draw string bag without a network pattern because a hem seal of the draw string bag without a network pattern would fail. Use of the higher density thermoplastic may have cost or physical property advantages. For example, a higher density linear low density polyethylene (LLDPE) may be used.

The bag may be produced by a high speed manufacturing process that processes continuous sheet-like webs of thermoplastic material into the finished bag via automated equipment. The process may include equipment, such as, seal bars, that the web or webs are directed between, that may form the side seals including the converging portions in a single, repeated step. Manufacturing the side seals in a single, repeated step may speed the manufacturing process and may reduce the cost of the finished bags.

In another aspect, the plastic bag may be produced through a high-speed manufacturing process which processes continuous webs of thermoplastic material into finished bags. The process may include adjacent first and second cylindrical rollers that can rotate in opposite rotational directions with respect to each other. The first roller may include a plurality of ridges protruding radially outward from the roller. At least some of the ridges may have segments of a first height and segments of a second height which are greater than the first height. The second roller may also include a plurality of ridges protruding radially outward from its cylindrical roller body. The rollers may be arranged so that the ridges of the first roller are received between the ridges of the second roller.

In operation, the initially planar web of pliable thermoplastic material is directed in between the rotating rollers. The network pattern can be formed by positioning the base film between toothed regions of plate and teeth of plate are incrementally and plastically formed creating rib-like elements in the network patterned regions of web material.

DETAILED DESCRIPTION

Figure 1:
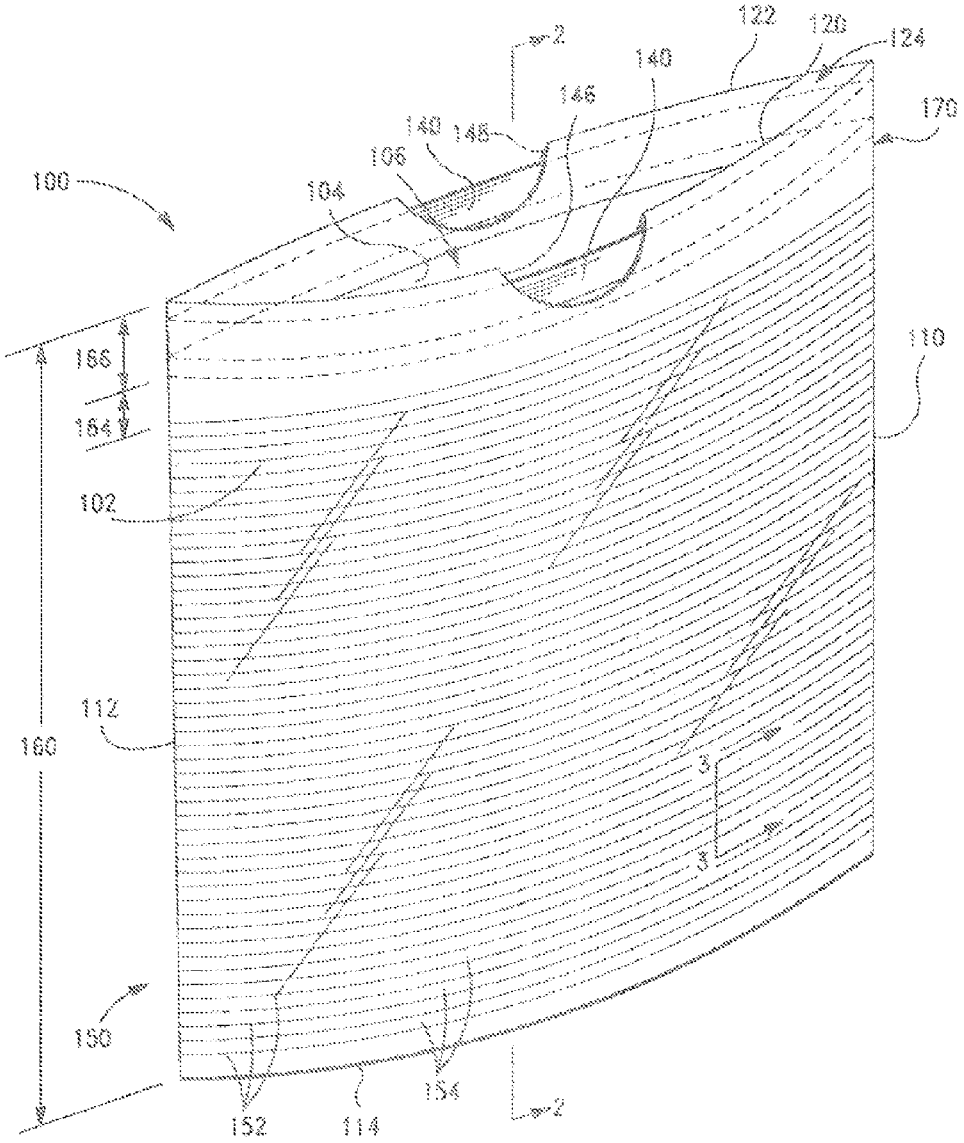
FIG. 1 is a perspective view of a thermoplastic bag for use as a trash container liner having a ribbed pattern imparted onto a sidewall of the bag.

Referring to FIG. 1, an embodiment of a flexible thermoplastic bag 100 is illustrated. While flexible bags are generally capable of holding a vast variety of different contents, the bag 100 illustrated in FIG. 1 may be intended to be used as a liner for a garbage can or similar refuse container. The bag 100 may be made from a first sidewall 102 and an opposing second sidewall 104 overlying the first sidewall to provide an interior volume 106 therebetween. The first and second sidewalls 102, 104 may be joined along a first side edge 110, a parallel or non-parallel second side edge 112, and a closed bottom edge 114 that may extend between the first and second side edges. The sidewalls 102, 104 may be joined along the first and second side edges 110, 112 and bottom edge 114 by any suitable process such as, for example, heat sealing. The bottom edge 114 may be formed by joining the first sidewall 102 to the second sidewall 104 by any suitable process. The bottom edge 114 may be formed by a fold between the first sidewall 102 and the second sidewall 104.

For accessing the interior volume 106 to, for example, insert refuse or garbage, the top edges 120, 122 of the first and second sidewalls 102, 104 may remain un-joined to define an opening 124 located opposite the closed bottom edge 114. When placed in a trash receptacle, the top edges 120, 122 of the first and second sidewalls 102, 104 may be folded over the rim of the receptacle. To close the opening 124 of the bag 100 when, for example, disposing of the trash receptacle liner, referring to FIGS. 1 and 2, the bag may be fitted with a draw tape 140. To accommodate the draw tape 140, referring to FIG. 2, the first top edge 120 of the first sidewall 102 may be folded back into the interior volume 106 and attached at the hem seal 170 to the interior surface of the sidewall to form a first hem 142. Similarly, the second top edge 122 of the second sidewall 104 may be folded back into the interior volume and attached to the second sidewall to form a second hem 144. In other embodiments, the hems may be folded to the exterior and attached to the exterior surface of the sidewall(s) at a hem seal. The draw tape 140, which may be fixedly attached at the first and second side edges 110, 112, may extend along the first and second top edge 120, 122 through the first and second hems 142, 144. To access the draw tape 140, first and second notches 146, 148 may be disposed through the respective first and second top edges 120, 122. Pulling the draw tape 140 through the notches 146, 148 may constrict the top edges 120, 122 thereby closing the opening 124.

The first and second sidewalls 102, 104 of the plastic bag 100 may be made of flexible or pliable thermoplastic material which may be formed or drawn into a web or sheet. Examples of suitable thermoplastic material may include polyethylene, such as, high density polyethylene, low density polyethylene, very low density polyethylene, ultra-low density polyethylene, linear low density polyethylene, polypropylene, ethylene vinyl acetate, nylon, polyester, ethylene vinyl alcohol, ethylene methyl acrylate, ethylene ethyl acrylate, or other materials, or combinations thereof, and may be formed in combinations and in single or multiple layers. The choice of the thermoplastic material will normally be based on cost and physical properties, however, the choice of the thermoplastic material must be suitable for the high speed manufacturing, for example, in forming the side seals and hem seals. When used as a garbage can liner, the thermoplastic material may be opaque but in other applications may be transparent, translucent, or tinted. Furthermore, the material used for the sidewalls may be a gas impermeable material.

Figure 2:
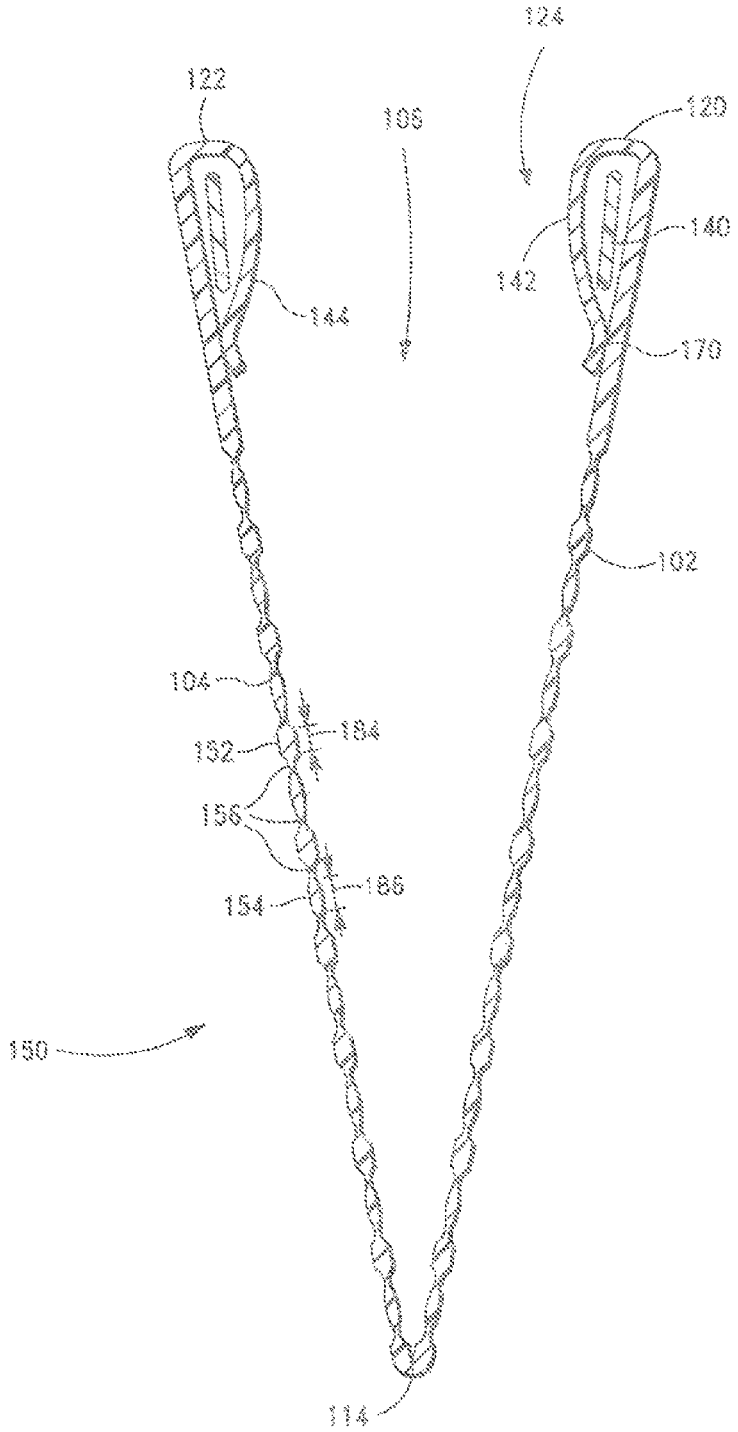
FIG. 2 is a cross-sectional view taken along line 2-2 of FIG. 1.
Figure 3A:
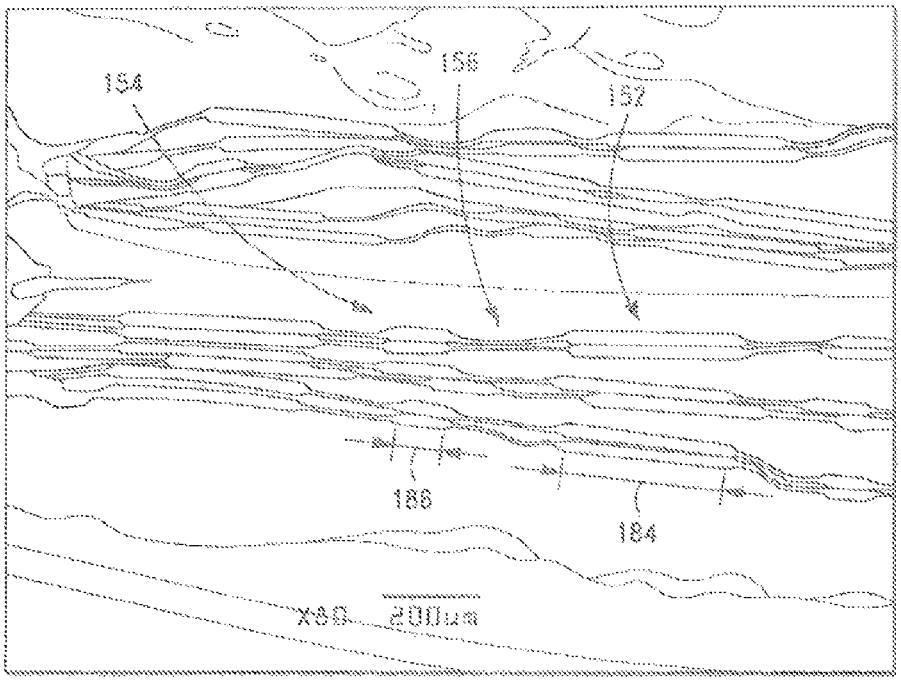
FIGS. 3A-D are drawings based on photomicrographs of film plies produced under the process of FIGS. 6 and 7.
Figure 3B:
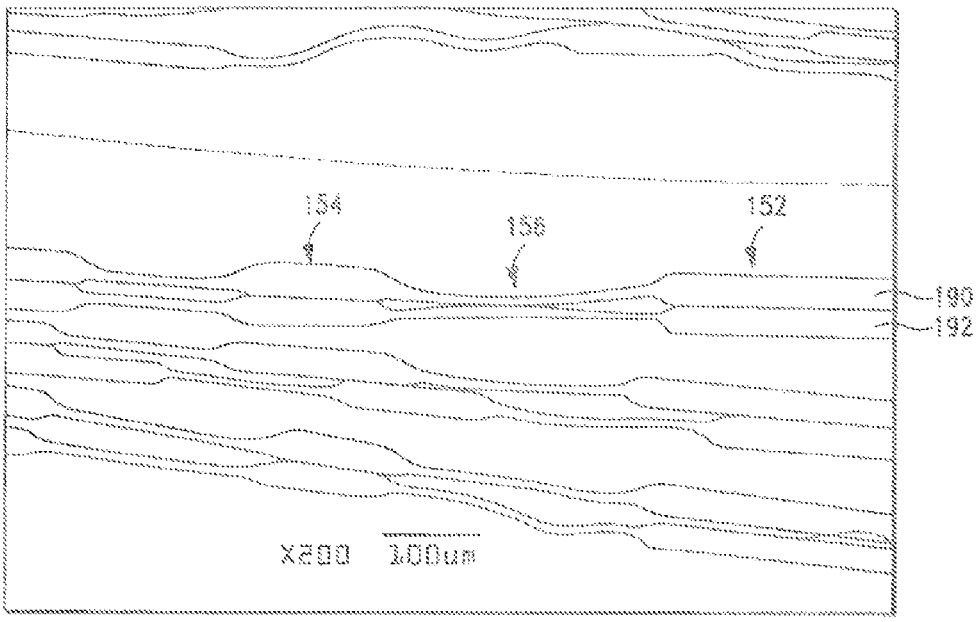
Figure 3C:
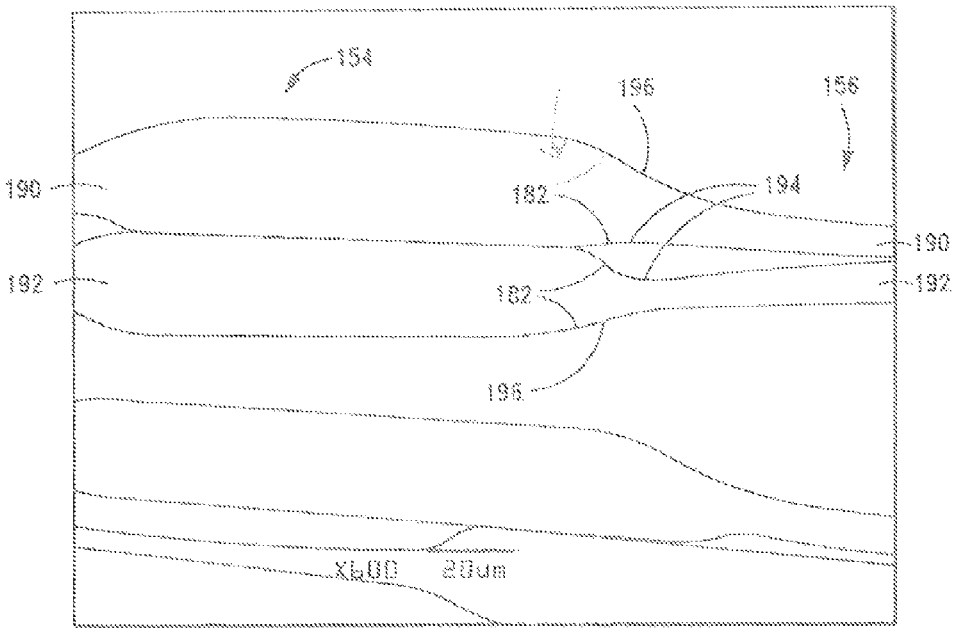

Referring to FIGS. 1, 2, and 3A-D, to provide the bag with desirable physical characteristics, a ribbed pattern 150 may be imparted onto at least a portion of the first sidewall of the bag. The ribbed pattern 150 may be formed by a process such as TD ring rolling as described in FIGS. 6 and 7 to produce the film plies as illustrated in FIGS. 2 and 3A-D. The ribbed pattern 150 may take the form of a plurality of alternating linear ribs 152 and 154 that may extend across the first sidewall 102 substantially between the first side edge 110 and second side edge 112. As illustrated in FIGS. 3A-C, the ribs 152 and 154 may be parallel and adjacent to one another such that the thermoplastic material of the sidewall 102 may have a general shape of alternating thick and thin sections. Additionally, as illustrated in FIG. 1, the ribbed pattern 150 may extend from above the bottom edge 114 toward the opening 124. To avoid interfering with the operation of the draw tape 140, the extension of the ribbed pattern 150 may terminate below the hem seal 170. The bag 100 may have a height 160 measured between the closed bottom edge 114 and the opening 124. The height 160 may have a first range of about 10 inches to 48 inches, a second range of about 24 inches to 40 inches, and a third range of about 27 inches to 36 inches. In one embodiment, the height 160 may be about 27.4 inches. The hem seal 170 can be a distance 166 below the opening 124. The distance 166 can have a first range of about 1.0 inches to 4.0 inches, a second range of about 1.5 inches to 3.5 inches, and a third range of about 2.0 inches to 3.0 inches. In one embodiment, the distance 166 may be about 2.25 inches. The ribbed pattern 150 can start a distance 164 below the hem seal 170. The distance 164 can have a first range of 0.25 inches to 8.0 inches, a second range of 0.25 inches to 4.0 inches, a third range of 0.5 inches to 2.0 inches. In one embodiment, the distance 164 may be about 1.0 inches.

Figure 3D:
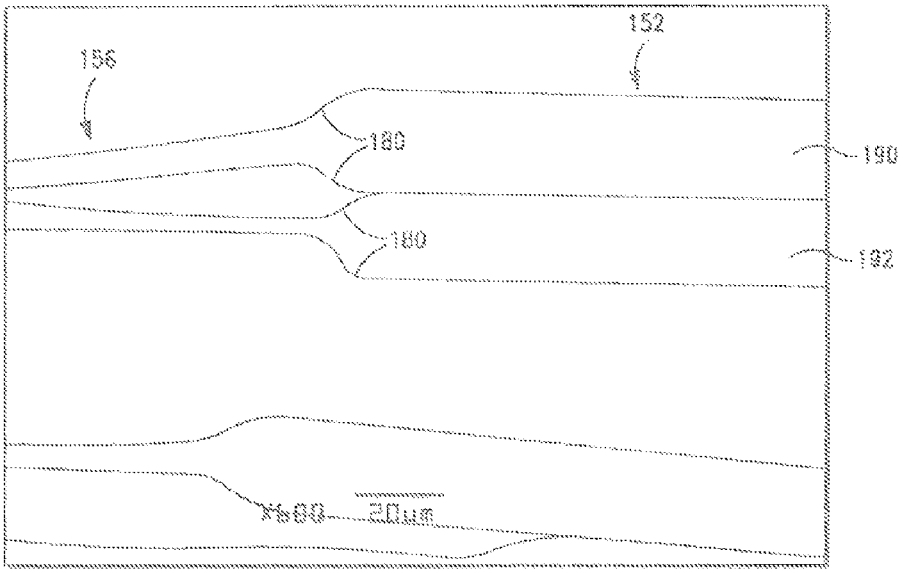

As shown in FIG. 2 and the drawings of FIGS. 3A-D, the ribbed pattern 150 consists of alternating linear ribs 152 and 154 separated by thin sections 156. FIGS. 3A-D show two film plies 190 and 192 formed side by side and which may form both sidewalls 102, 104 of bag 100 of FIG. 1. This is a result of putting two plies together through the processing conditions described in FIGS. 4 and 5. FIG. 3A shows the cross-sectional slice at 80× magnification. FIG. 3B shows a subsection of the same cross-sectional slice at 200× magnification. FIGS. 3C and 3D show different subsections of 3B at 600× magnification. The linear ribs 152 have a sharp, hour glass shaped angle 180 separating the linear ribs 152 from the thin sections 156. The linear ribs 154 have smooth, gradual shaped angle 182 separating the linear ribs 154 from the thin sections. Referring to FIGS. 2 and 3A depending upon the processing conditions, the length 184 of the ribs 152 and the length 186 of the ribs 154 can vary. However, the length 184 is generally greater than the length 186 as shown in FIG. 3A. When two film plies 190 and 192 are formed side by side, the angle 182 between the ribs 154 and the thin sections 156 is not symmetrical but is generally shallower on the inside 194 of the film plies 190, 192 compared to the outside 196 of the film plies 190, 192. The sharp angles 180 of the linear ribs 152 are relatively symmetrical. From FIGS. 4 and 6, the web 202, either a single ply 202 or a first half ply 222 and a second half ply 224 is fed through rollers 242, 244 in the machine direction 206 to create alternating ribs 152 and 154 running in the machine direction 206 and perpendicular to the transverse direction 207.

Figures 4, 5:
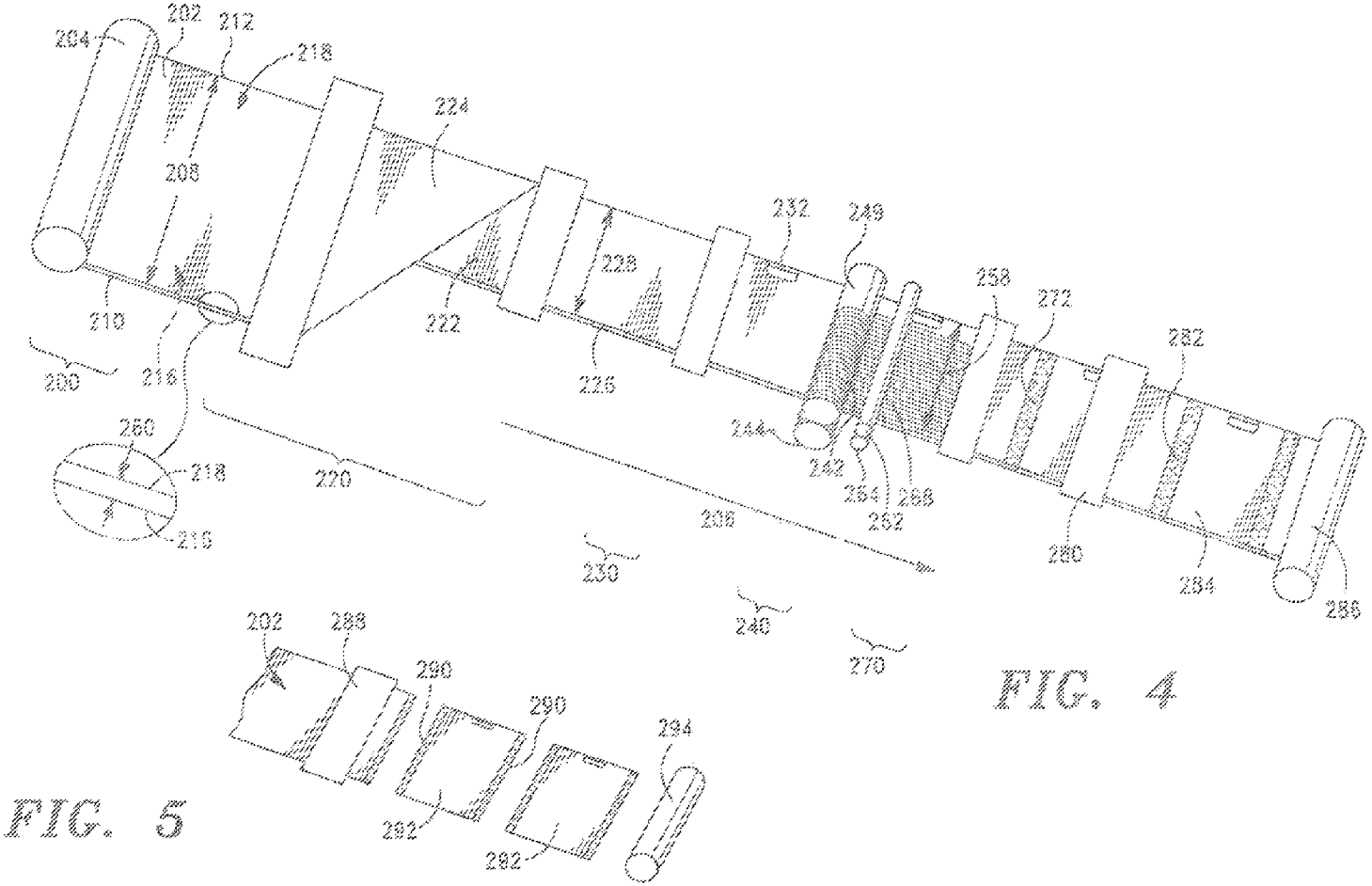
FIG. 4 is a schematic view depicting a high-speed manufacturing process for producing thermoplastic bags having ribbed patterns from a continuous web of thermoplastic material.
FIG. 5 is a schematic view of the final steps of another embodiment of the high-speed manufacturing process.

To produce a bag having a ribbed pattern as described, continuous webs of thermoplastic material may be processed through a high-speed manufacturing environment such as illustrated in FIG. 4. In the illustrated process, production may begin in a step 200 by unwinding a continuous web 202 of thermoplastic sheet material from a roll 204 and advancing the web along a machine direction 206. The unwound web 202 may have a width 208 that may be perpendicular to the machine direction 206 as measured between a first edge 210 and an opposite second edge 212. The unwound web 202 may have an initial average thickness measured between a first surface 216 and a second surface 218. In other manufacturing environments, the web 202 may be provided in other forms or even extruded directly from a thermoplastic forming process.

To provide the first and second sidewalls of the finished bag, the web 202 may be folded into a first half 222 and an opposing second half 224 about the machine direction 206 by a folding operation 220. When so folded, the first edge 210 may be moved adjacent to the second edge 212 of the web. Accordingly, the width of the web proceeding in the machine direction 206 after the folding operation 220 may be a width 228 that may be half the initial width 208 after the unwinding step 200. As may be appreciated, the portion mid-width of the unwound web 202 may become the outer edge 226 of the folded web. In another embodiment, the roll 204 may include a pre-folded web and the folding operation is not necessary. The hems may be formed along the adjacent first and second edges 210, 212 and the draw tape 232 may be inserted during a hem and draw tape operation 230.

Figure 6:
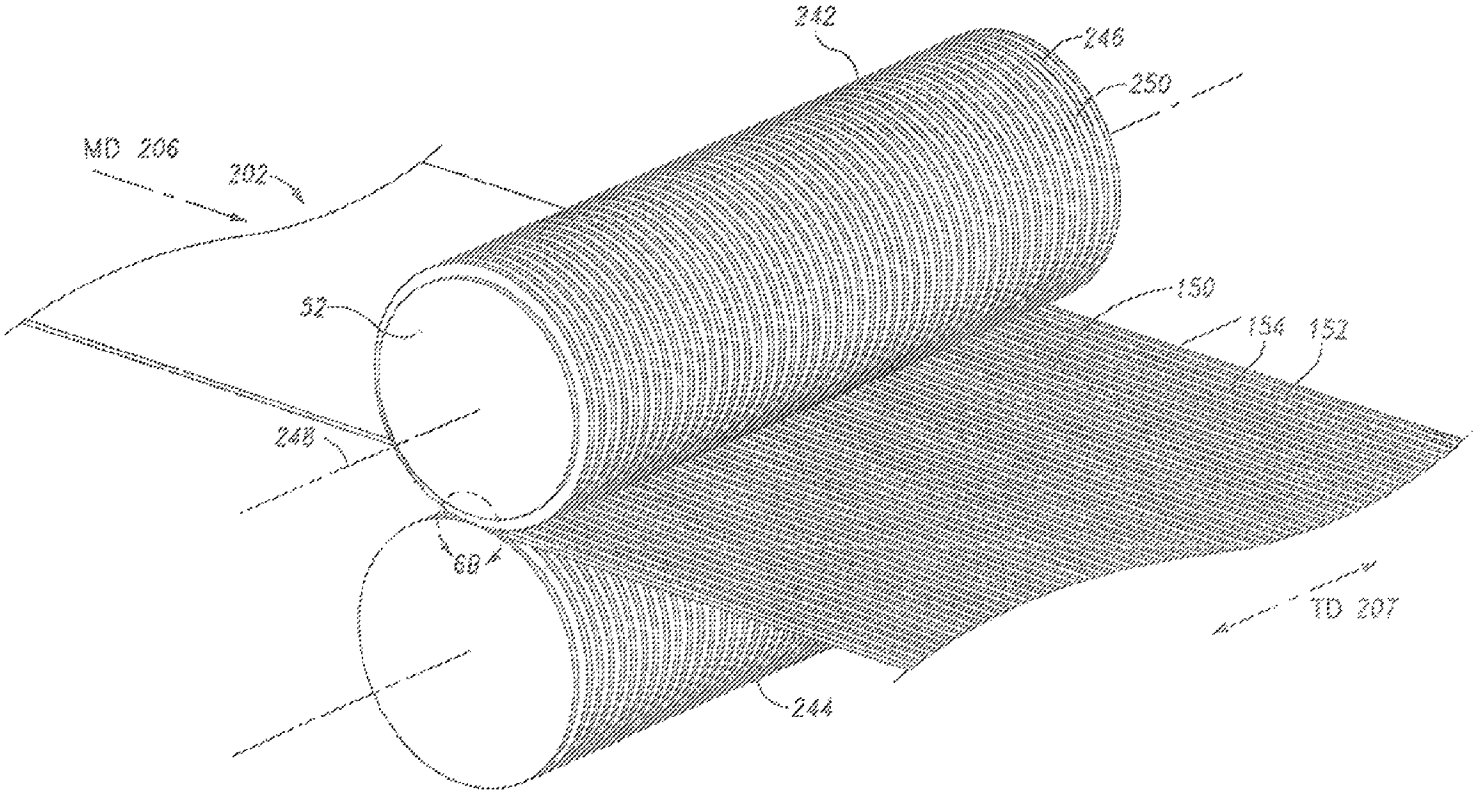
FIG. 6 is a perspective view of the cylindrical rollers, arranged in parallel and adjacent to each other, used to impart the ribbed pattern onto a thermoplastic web.
Figure 7:
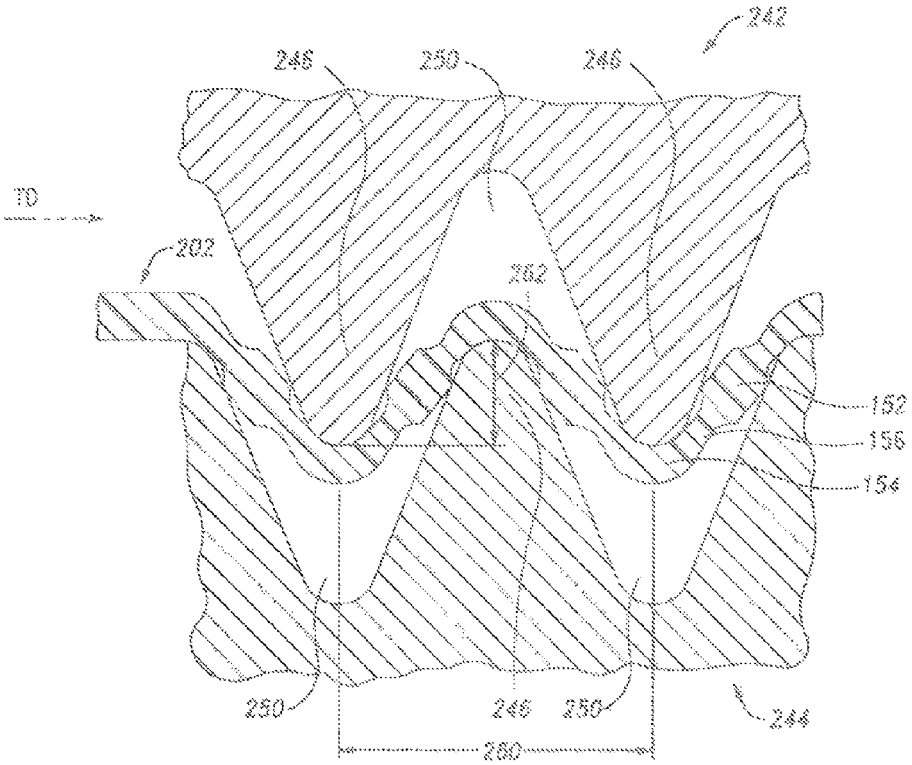
FIG. 7 is a view of the cylindrical rollers taken along circle 6B of FIG. 6 depicting the intermeshing of the cylindrical rollers including the protruding circular ridges and the accommodating grooves.

To impart the ribbed pattern, the processing equipment may include a first cylindrical roller 242 and a parallel, adjacently arranged second cylindrical roller 244 that may accomplish the imparting process 240. The rollers 242, 244 may be arranged so that their longitudinal axes may be perpendicular to the machine direction 206 and may be adapted to rotate about their longitudinal axes in opposite rotational directions. In various embodiments, motors may be provided that power rotation of the rollers 242, 244 in a controlled manner. The cylindrical rollers may be made of cast and/or machined metal such as steel or aluminum. Referring to FIGS. 6 and 7, the cylindrical surface of both the first and second rollers 242, 244 may include a plurality of protruding ridges 246 that may encircle the cylindrical axis 248. The circular ridges 246 may be arranged parallel to one another and may extend along the axial length of the cylinder. Moreover, the circular ridges 246 may be spaced apart from one another to provide corresponding grooves 250 therebetween. The pattern of the circular ridges 246 on the first roller 242 may be axially offset or staggered with respect to the pattern of circular ridges on the second roller 244 such that, when the rollers are aligned adjacently, the ridges of each roller may be received in and accommodated by the grooves 250 of the other roller. In this sense, the alternating ridges and grooves of the two cylindrical rollers may mesh together. One will appreciate in light of the disclosure herein that the striped pattern 150 may vary depending on the method used to incrementally stretch the film 202. To the extent that TD ring rolling is used to incrementally cold stretch the film 202, the striped pattern 150 of ribs 152, 154 on the film ply 202 (or multiple plies 190, 192 in FIG. 3B) can depend on the pitch 260 of the ridges 246, the depth of engagement or DOE 262, and other factors.

Referring to FIG. 4, the folded web 202 may be advanced along the machine direction 206 between the first and second rollers 242, 244 which may be set into rotation in opposite rotational directions to impart the resulting web pattern 268. As illustrated in FIGS. 6 and 7, the ridges 246 may stretch the web 202 into the corresponding grooves 250. The stretching may occur in tensile and shear modes. The meshing action of the ridges 246 and grooves 250 may impart onto the web 202 a pattern or shape of alternating ribs 152, 154 separated by thin sections 156. To facilitate patterning of the web 202, the first roller 242 and second roller 244 may be forced or directed against each other by, for example, hydraulic actuators. The pressure at which the rollers are pressed together may be in a first range from 30 PSI (2.04 atm) to 100 PSI (6.8 atm), a second range from 60 PSI (4.08 atm) to 90 PSI (6.12 atm), and a third range from 75 PSI (5.10 atm) to 85 PSI (5.78 atm). In one embodiment, the pressure may be about 80 PSI (5.44 atm).

In the illustrated embodiment, the first and second rollers may be arranged so that they are co-extensive with or wider than the width 228 of the folded web. In one embodiment, the rollers 242, 244 may extend from proximate the outer edge 226 to the adjacent edges 210, 212. To avert imparting the ribbed pattern onto the portion of the web that includes the draw tape 232, the corresponding ends 249 of the rollers 242, 244 may be smooth and without the ridges and grooves. Thus, the adjacent edges 210, 212 and the corresponding portion of the web proximate those edges that pass between the smooth ends 249 of the rollers 242, 244 may not be ribbed.

In one embodiment, the web 202 may be stretched to reduce its thickness as it passes between the rollers. Referring to FIG. 4, the web 202 when it is unwound from the roll 204 may have an average thickness 260, measured between the first surface 216 and a second surface 218. The average thickness 260 may have a first range of about 0.0007 inches to 0.0014 inches, a second range of about 0.0008 inches to 0.0012 inches, and a third range of about 0.0009 inches to 0.0011 inches. In one embodiment, the average thickness may be 0.001 inches. After passing between the rollers 242, 244, the web may have an average thickness that is reduced. The average thickness may be in a first range of about 0.0005 inches to 0.0012 inches, a second range of 0.0006 inches to 0.0009 inches, and a third range of about 0.00065 inches to 0.0008 inches. In one embodiment, the average thickness may be about 0.0007 inches. The average thickness may reduced to 85% or less of the original average thickness, or to 90% or less of the first average thickness, or to 80% or less of the first average thickness, or to 70% or less of the first average thickness. Of course, other reductions in average thickness may be possible and may be achieved by varying the initial average thickness of the web, by adjusting spacing of the rollers, and by adjusting the pressure at which the rollers are pressed or forced together.

One result of reducing the thickness of the web material is that the alternating ribbed pattern 150 or 268 may be imparted into the web. The thermoplastic material of the web may be stretched or worked during reduction such that the initially planar web takes the new alternating ribbed shape. In some embodiments, the molecular structure of the thermoplastic material may be rearranged to provide this shape memory.

Referring to FIG. 4, another result of reducing the web thickness is that some of the web material may be stretched longitudinally along the rollers 242, 244 and perpendicular to the machine direction 206. Also, some of the web material may be compressed longitudinally along the rollers 242, 244. This action may widen the folded web from its initial width 228 to a larger width 258. To facilitate the widening of the web, the adjacent edges 210, 212 of the web may be located between the smooth ends 249 of the rollers 242, 244. The smooth ends 249 of the rollers 242, 244 can maintain alignment of the web along the machine direction. The processing equipment may include pinch rollers 262, 264 to accommodate the growing width of the widening web.

The processed web may have varying thickness as measured along its width perpendicular of the machine direction. Because the ridges 246 and the grooves 250 on the rollers 242, 244 may not be co-extensive with the width 228 of the folded web 202, only the thickness of that portion of the web which is directed between the ridges and the grooves may be reduced. The remaining portion of the web, such as, toward the adjacent edge 210, 212, may retain the web's original thickness. The smooth ends 249 of the rollers 242, 244 may have diameters dimensioned to accommodate the thickness of that portion of the web which passes therebetween.

To produce the finished bag, the processing equipment may further process the folded web with the ribbed pattern. For example, to form the parallel side edges of the finished bag, the web may proceed through a sealing operation 270 in which heat seals 272 may be formed between the outer edge 226 and the adjacent edges 210, 212. The heat seals may fuse together the adjacent halves 222, 224 of the folded web. The heat seals 272 may be spaced apart along the folded web and in conjunction with the folded outer edge 226 may define individual bags. The heat seals may be made with a heating device, such as, a heated knife. A perforating operation 280 may perforate 282 the heat seals 272 with a perforating device, such as, a perforating knife so that individual bags 284 may be separated from the web. In another embodiment, the web may be folded one or more times before the folded web may be directed through the perforating operation. The web 202 embodying the finished bags 284 may be wound into a roll 286 for packaging and distribution. For example, the roll 286 may be placed in a box or a bag for sale to a customer.

In another embodiment of the process which is illustrated in FIG. 5, a cutting operation 288 may replace the perforating operation 280 in FIG. 4. Referring to FIG. 5, the web is directed through a cutting operation 288 which cuts the web at location 290 into individual bags 292 prior to winding onto a roll 294 for packaging and distribution. For example, the roll 294 may be placed in a box or bag for sale to a customer. The bags may be interleaved prior to winding into the roll 294. In another embodiment, the web may be folded one or more times before the folded web is cut into individual bags. In another embodiment, the bags 292 may be positioned in a box or bag, and not onto the roll 294. The bags may be interleaved prior to positioning in the box or bag.

These manufacturing embodiments may be used with any of the manufacturing embodiments described herein, as appropriate.

Figure 8:
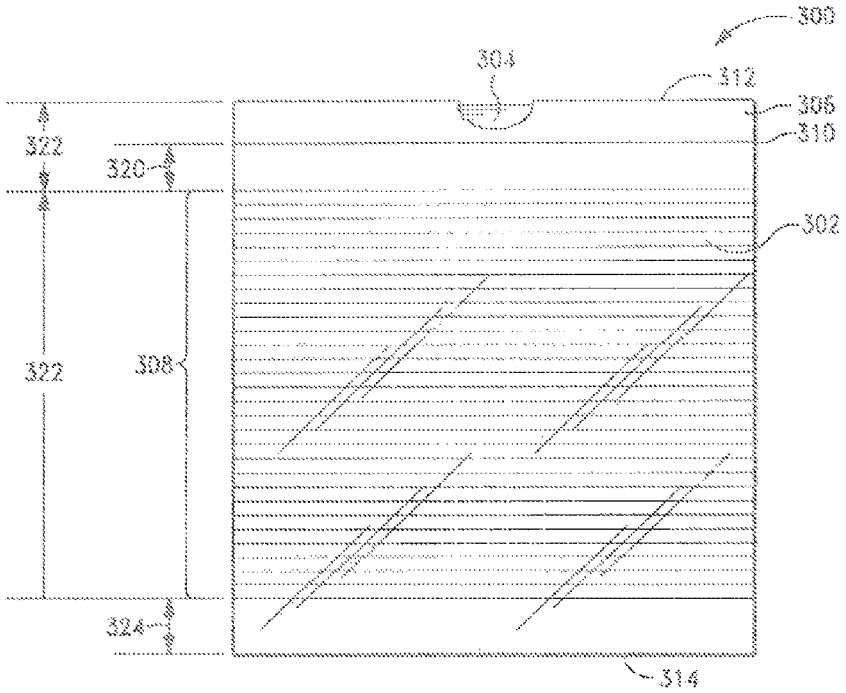
FIG. 8 is a front elevational view of another embodiment of the thermoplastic bag for use as a trash receptacle liner.

Referring now to FIG. 8, there is illustrated another embodiment of a bag 300 for use as a trash receptacle liner. The bag 300 may include a first sidewall 302 of thermoplastic material, a draw tape 304, a hem 306, and a ribbed pattern area 308. The ribbed pattern area 308 is a distance 320 below the hem seal 310 and a distance 322 below the bag top 312. The ribbed patterned area 308 does not reach to the bag bottom 314 but is a distance 324 from the bag bottom 314. The ribbed patterned area 308 extends a distance 326 from top to bottom and typically extends across the entire width of the bag. Although the ribbed pattern 308 may in other cases extend all the way to the bag bottom 314, it has surprisingly been found that in the case of the ribbed pattern 150 described in FIGS. 2 and 3A-D, that extending the ribbed pattern 150 all the way to the bag bottom 314 would decrease the overall bag thickness in the critical area adjacent to the bag bottom 314 described by the distance 324. The distance 322 can have a first range of about 1.0 inches to 8.0 inches, a second range of about 1.5 inches to 4.0 inches, and a third range of about 2.0 inches to 3.0 inches. In one embodiment, the distance 322 may be about 2.5 inches. The distance 320 can have a first range of 0.25 inches to 7.0 inches, a second range of 0.25 inches to 4.0 inches, a third range of 0.5 inches to 2.0 inches. In one embodiment, the distance 320 may be about 1.0 inches. The distance 324 can have a first range of 0.25 inches to 12.0 inches, a second range of 0.5 inches to 8.0 inches, a third range of 0.5 inches to 4.0 inches. In one embodiment, the distance 320 may be about 4.0 inches. The distance 326 can have a first range of 10.0 inches to 22.0 inches, a second range of 12.0 inches to 21.0 inches, a third range of 14.0 inches to 20.0 inches. In one embodiment, the distance 320 may be about 21.0 inches.

Figure 9:
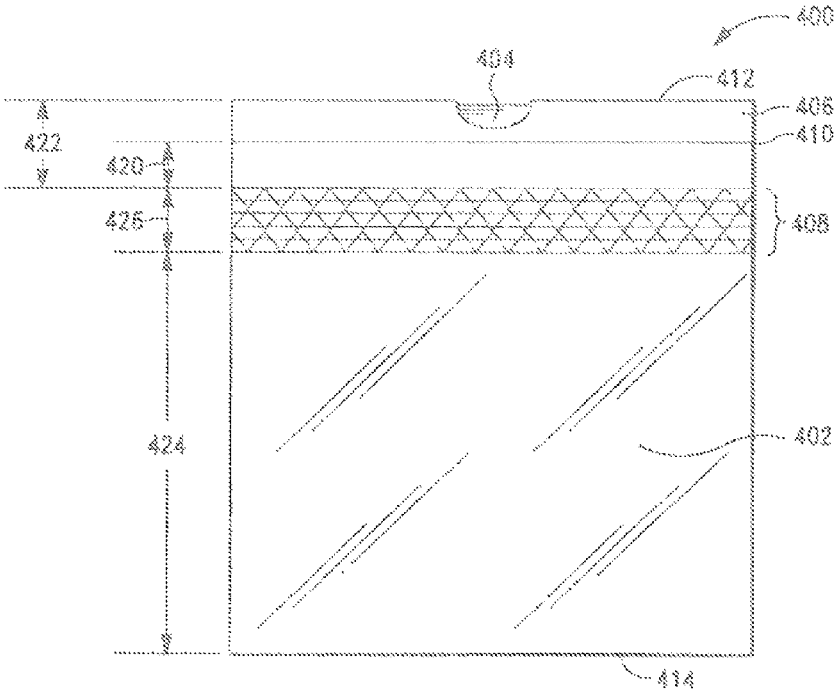
FIG. 9 is a front elevational view of another embodiment of the thermoplastic bag for use as a trash receptacle liner.

Referring now to FIG. 9, there is illustrated another embodiment of a bag 400 for use as a trash receptacle liner. The bag 400 may include a first sidewall 402 of thermoplastic material, a draw tape 404, a hem 406, and a network pattern area 408. The network pattern area 408 can be formed by a process such as the SELF process described in FIGS. 10 and 11. The network pattern area 408 is a distance 420 below the hem seal 410 and a distance 422 below the bag top 412. The network patterned area 408 does not reach to the bag bottom 414 but is a distance 424 from the bag bottom 414. The network patterned area 408 extends a distance 426 from top to bottom and typically extends across the entire width of the bag. Although the network patterned area 408 may result in greater loft to the film, the average thickness does not appreciably change compared to the unpatterned area. In one example, there is a consistent film thickness of about 0.95 mil from the bag top 412 to the bag bottom 414.

The distance 422 can have a first range of about 1.0 inches to 8.0 inches, a second range of about 1.5 inches to 4.0 inches, and a third range of about 2.0 inches to 3.0 inches. In one embodiment, the distance 422 may be about 2.5 inches. The distance 420 can have a first range of 0.25 inches to 7.0 inches, a second range of 0.25 inches to 4.0 inches, a third range of 0.5 inches to 2.0 inches. In one embodiment, the distance 420 may be about 1.0 inches. The distance 424 can have a first range of 0.25 inches to 24.0 inches, a second range of 4.0 inches to 22.0 inches, a third range of 10.0 inches to 21.0 inches. In one embodiment, the distance 420 may be about 20.0 inches. The distance 426 can have a first range of 1.0 inches to 7.0 inches, a second range of 1.0 inches to 4.0 inches, a third range of 1.0 inches to 2.0 inches. In one embodiment, the distance 426 may be about 1.5 inches.

Figure 10:
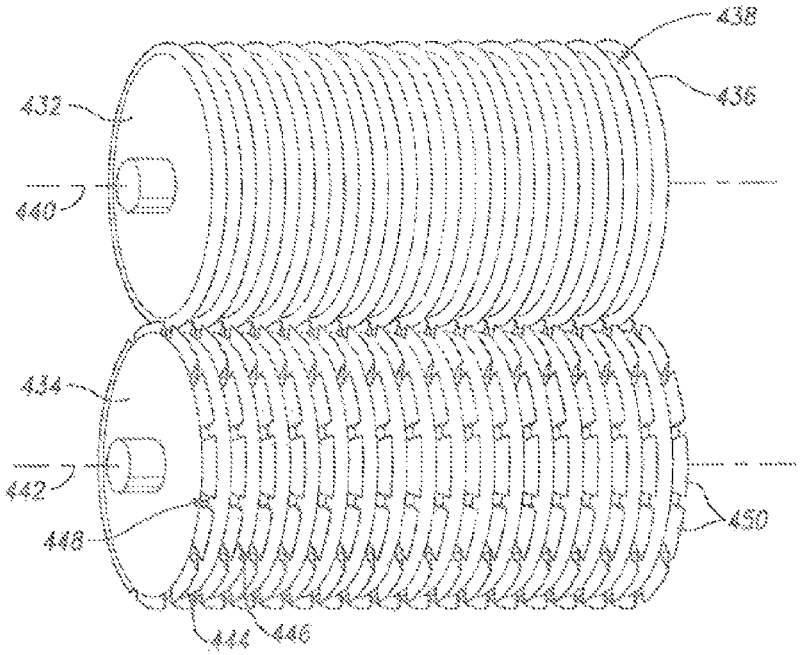
FIG. 10 illustrates a schematic diagram of a set of intermeshing rollers used to form a structural elastic like film (SELF) by imparting cold stretched strainable networks into the film in accordance with one or more implementations of the present invention.

FIG. 10 illustrates a pair of SELF'ing intermeshing rollers 432, 434 for creating cold stretched, strainable networks of a single ply or of lightly bonded multiple plies of film. The first SELF'ing intermeshing roller 432 can include a plurality of ridges 436 and grooves 438 extending generally radially outward in a direction orthogonal to an axis of rotation 440. Thus, the first SELF'ing intermeshing roller 432 can be similar to a TD intermeshing roller 242, 244 of FIG. 6. The second SELF'ing intermeshing roller 434 can also include a plurality of ridges 444 and grooves 446 extending generally radially outward in a direction orthogonal to an axis of rotation 442. As shown by FIG. 10, however, the ridges 444 of the second SELF'ing intermeshing roller 434 can include a plurality of notches 448 that define a plurality of spaced teeth 450.

Figure 11:
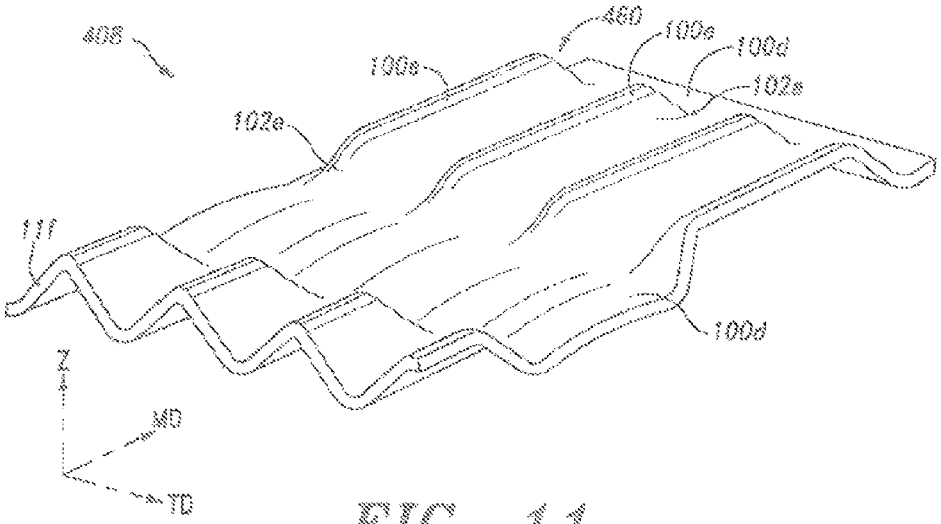
FIG. 11 illustrates a view of a multi-ply, cold stretched, laminated thermoplastic film created by the intermeshing rollers of FIG. 10.

Referring now to FIG. 11, a stretched film ply corresponding to network patterned area 408 of FIG. 9 created using the SELF'ing intermeshing rollers 432, 434 of FIG. 10 is shown. In particular, as the film passes through the SELF'ing intermeshing rollers 432, 434, the teeth 450 can press a portion of the web 408 out of plane to cause permanent deformation and stretching of a portion of the film in the Z-direction. The portions of the film that pass between the notched regions 448 of the teeth 444 will be substantially unformed in the Z-direction, resulting in a plurality of deformed, raised, rib-like elements 460. The length and width of rib-like elements 460 depends on the length and width of teeth 450. As shown by FIG. 11, the strainable network of the film 408 can include first un-deformed regions 100*d*, second un-deformed rib peak regions, and stretched and thinned transitional regions 102*e* connecting the first and second un-deformed regions 100*d*, 100*e*. The second un-deformed regions 100*e* and the thinned transitional regions 102*e* can form the raised rib-like elements 460 of the strainable network. The thinned transitional regions 102*e* can be discontinuous or separated as they extend across the film 408 in both transverse TD and machine MD directions. This is in contrast to ribs that extend continuously across a film in one of the machine MD or transverse TD directions.

The rib-like elements 460 can allow the film 408 to undergo a substantially "geometric deformation" prior to a "molecular-level deformation" or a "macro-level deformation." As used herein, the term "molecular-level deformation" refers to deformation which occurs on a molecular level and is not discernible to the normal naked eye. That is, even though one may be able to discern the effect of molecular-level deformation, e.g., macro-level deformation of the film, one is not able to discern the deformation which allows or causes it to happen. As used herein, the term "macro-level deformation" refers to the effects of "molecular-level deformation," such as stretching, tearing, puncturing, etc. In contrast, the term "geometric deformation," which refers to deformations of multi-ply lightly-laminated film 10*m* which are generally discernible to the normal naked eye, but do not cause the molecular-level deformation when the multi-ply film 10*m* or articles embodying the multi-ply lightly-laminated film 10*m* are subjected to an applied strain. Types of geometric deformation include, but are not limited to bending, unfolding, and rotating.

Thus, upon application of strain, the rib-like elements 460 can undergo geometric deformation before either the rib-like elements 460 or the flat regions undergo molecular-level deformation. For example, an applied strain can pull the rib-like elements 460 back into plane with the flat regions prior to any molecular-level deformation of the multi-layered film 10*m*. Geometric deformation can result in significantly less resistive forces to an applied strain than that exhibited by molecular-level deformation.

Figure 12:
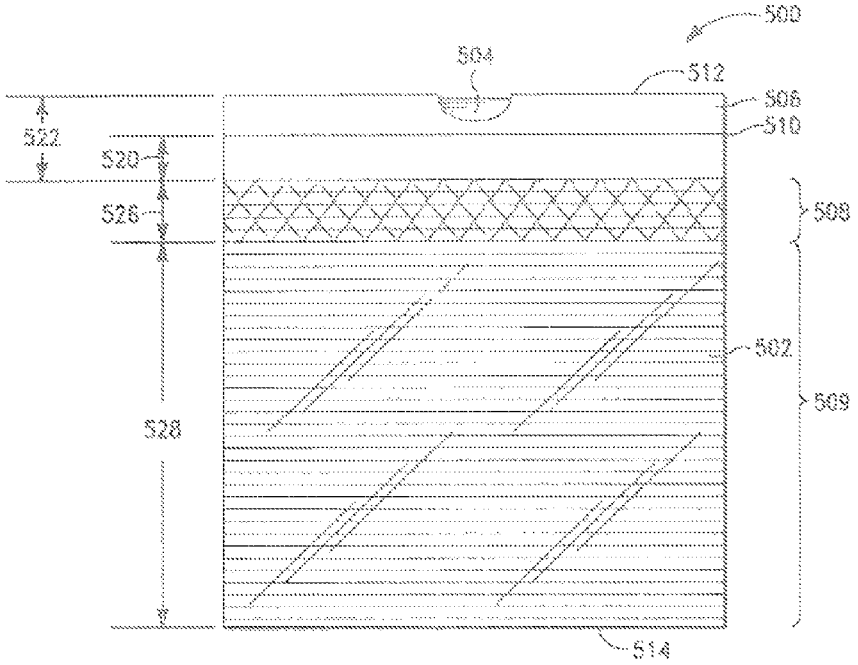
FIG. 12 is a front elevational view of another embodiment of the thermoplastic bag for use as a trash receptacle liner.

Referring now to FIG. 12, there is illustrated another embodiment of a bag 500 for use as a trash receptacle liner. The bag 500 may include a first sidewall 502 of thermoplastic material, a draw tape 504, a hem 506, a network pattern area 508 immediately adjacent to and bordering a ribbed patterned area 509. The network patterned area 508 is a distance 520 below the hem seal 510 and a distance 522 below the bag top 512. The network patterned area 508 interacts with the ribbed patterned area 509 to optimize the bag maximum load to break properties. The ribbed patterned area 509 reaches to the bag bottom 514. The network patterned area 508 extends a distance 526 from top to bottom and typically extends across the entire width of the bag. The ribbed patterned area 509 extends a distance 528 from top to bottom and typically extends across the entire width of the bag. The distance 522 can have a first range of about 1.0 inches to 8.0 inches, a second range of about 1.5 inches to 4.0 inches, and a third range of about 2.0 inches to 3.0 inches. In one embodiment, the distance 522 may be about 2.5 inches. The distance 520 can have a first range of 0.25 inches to 7.0 inches, a second range of 0.25 inches to 4.0 inches, a third range of 0.5 inches to 2.0 inches. In one embodiment, the distance 520 may be about 1.0 inches. The distance 526 can have a first range of 0.25 inches to 12.0 inches, a second range of 0.5 inches to 8.0 inches, a third range of 0.5 inches to 4.0 inches. In one embodiment, the distance 526 may be about 4.0 inches. The distance 528 can have a first range of 10.0 inches to 22.0 inches, a second range of 12.0 inches to 21.0 inches, a third range of 14.0 inches to 20.0 inches. In one embodiment, the distance 528 may be about 21.0 inches.

Although the network patterned area 508 may result in greater loft to the film, the average thickness does not appreciably change compared to the unpatterned area. In one example, there is a consistent film thickness of about 0.95 mil in the network patterned and unpatterned areas and a film thickness of about 0.8 mil in the ribbed patterned area 509.

Figure 13:
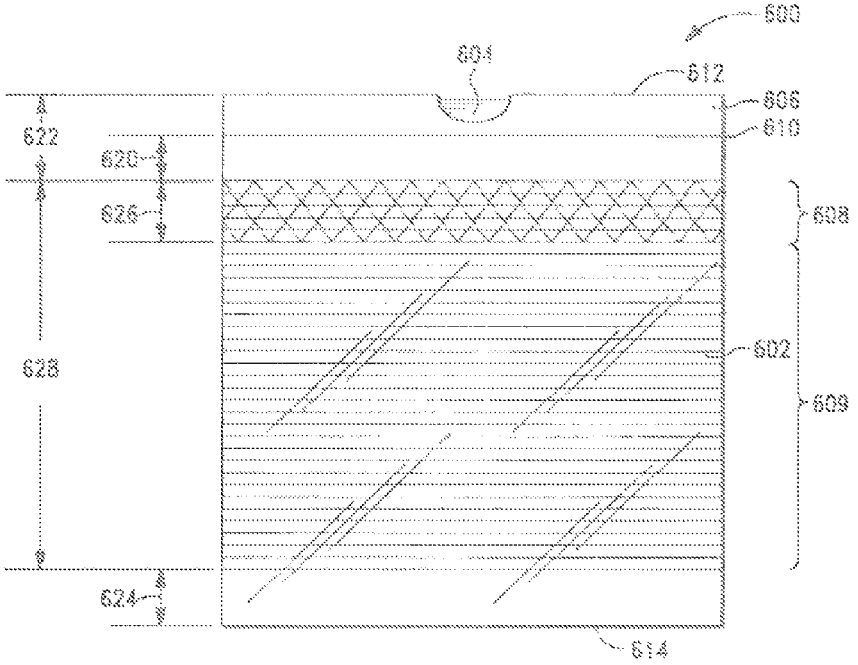
FIG. 13 is a front elevational view of another embodiment of the thermoplastic bag for use as a trash receptacle liner.

Referring now to FIG. 13, there is illustrated another embodiment of a bag 600 for use as a trash receptacle liner. The bag 600 may include a first sidewall 602 of thermoplastic material, a draw tape 604, a hem 606, a network pattern area 608 and a ribbed patterned area 609. The network patterned area 608 is a distance 620 below the hem seal 610 and a distance 622 below the bag top 612. The network patterned area 608 borders the ribbed patterned area 609. The ribbed patterned area 609 does not reach to the bag bottom 614 but is a distance 624 from the bag bottom 614. Although the ribbed pattern 609 may in other cases extend all the way to the bag bottom 614, it has surprisingly been found that in the case of the ribbed pattern 150 described in FIGS. 2 and 3A-D, that extending the ribbed pattern 150 all the way to the bag bottom 614 would decrease the overall bag thickness in the critical area adjacent to the bag bottom 614 described by the distance 624.

The network patterned area 608 extends a distance 626 from top to bottom and typically extends across the entire width of the bag. The ribbed patterned area 609 extends a distance 628 from top to bottom and typically extends across the entire width of the bag. The distance 622 can have a first range of about 1.0 inches to 8.0 inches, a second range of about 1.5 inches to 4.0 inches, and a third range of about 2.0 inches to 3.0 inches. In one embodiment, the distance 622 may be about 2.5 inches. The distance 620 can have a first range of 0.25 inches to 7.0 inches, a second range of 0.25 inches to 4.0 inches, a third range of 0.5 inches to 2.0 inches. In one embodiment, the distance 620 may be about 1.0 inches. The distance 624 can have a first range of 0.25 inches to 12.0 inches, a second range of 0.5 inches to 8.0 inches, a third range of 0.5 inches to 4.0 inches. In one embodiment, the distance 624 may be about 4.0 inches. The distance 626 can have a first range of 0.25 inches to 12.0 inches, a second range of 0.5 inches to 8.0 inches, a third range of 0.5 inches to 4.0 inches. In one embodiment, the distance 626 may be about 4.0 inches. The distance 628 can have a first range of 10.0 inches to 22.0 inches, a second range of 12.0 inches to 21.0 inches, a third range of 14.0 inches to 20.0 inches. In one embodiment, the distance 628 may be about 21.0 inches.

Figure 14:
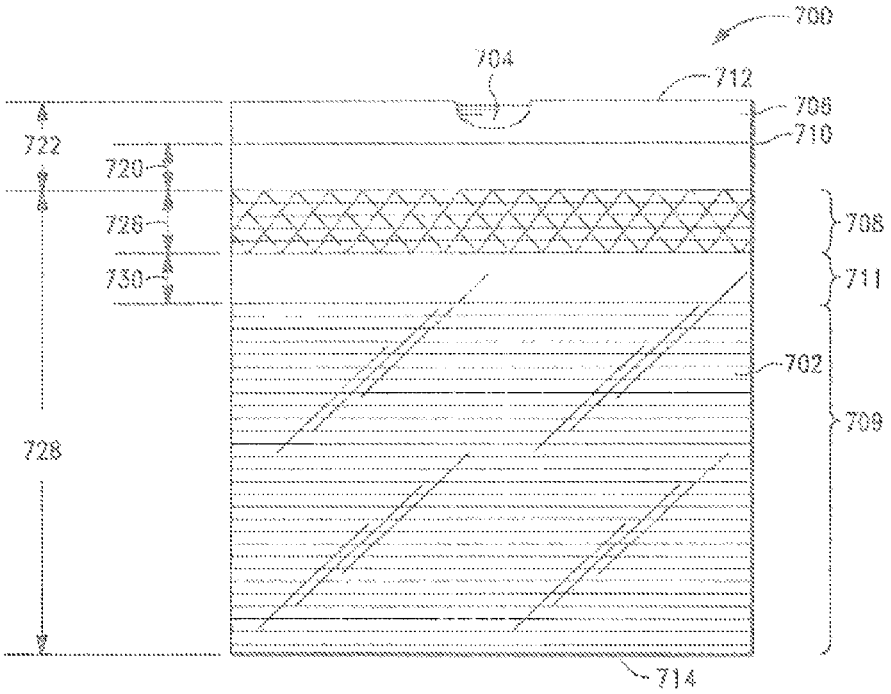
FIG. 14 is a front elevational view of another embodiment of the thermoplastic bag for use as a trash receptacle liner.

Referring now to FIG. 14, there is illustrated another embodiment of a bag 700 for use as a trash receptacle liner. The bag 700 may include a first sidewall 702 of thermoplastic material, a draw tape 704, a hem 706, a network pattern area 708 and a ribbed patterned area 709. The network patterned area 708 is a distance 720 below the hem seal 710 and a distance 722 below the bag top 712. The network patterned area 708 is separated from the ribbed patterned area 709 by an un-patterned area 711. The un-patterned area 711 extends a distance 730 from top to bottom. The ribbed patterned area 709 reaches to the bag bottom 714. The network patterned area 708 extends a distance 726 from top to bottom and typically extends across the entire width of the bag. Because the ribbed patterned area 709 is separated from the network patterned area 708 by the un-patterned area 711, the network patterned area 708 will not be able to synergistically interact with the ribbed patterned area 709 compared to that where they are immediately adjacent, as in FIG. 13. This will especially be the case where the networked patterned area 708 is of the type described in FIGS. 10 and 11 and the ribbed patterned area 709 is of the type described in FIGS. 2 and 3A-D. The ribbed patterned area 709 extends a distance 728 from top to bottom and typically extends across the entire width of the bag. The distance 722 can have a first range of about 1.0 inches to 8.0 inches, a second range of about 1.5 inches to 4.0 inches, and a third range of about 2.0 inches to 3.0 inches. In one embodiment, the distance 722 may be about 2.5 inches. The distance 720 can have a first range of 0.25 inches to 7.0 inches, a second range of 0.25 inches to 4.0 inches, a third range of 0.5 inches to 2.0 inches. In one embodiment, the distance 720 may be about 1.0 inches. The distance 726 can have a first range of 0.25 inches to 12.0 inches, a second range of 0.5 inches to 8.0 inches, a third range of 0.5 inches to 4.0 inches. In one embodiment, the distance 726 may be about 4.0 inches. The distance 728 can have a first range of 10.0 inches to 22.0 inches, a second range of 12.0 inches to 21.0 inches, a third range of 14.0 inches to 20.0 inches. In one embodiment, the distance 728 may be about 21.0 inches. The distance 730 can have a first range of 0.25 inches to 7.0 inches, a second range of 0.25 inches to 4.0 inches, a third range of 0.5 inches to 2.0 inches. In one embodiment, the distance 730 may be about 1.0 inches.

Figure 15:
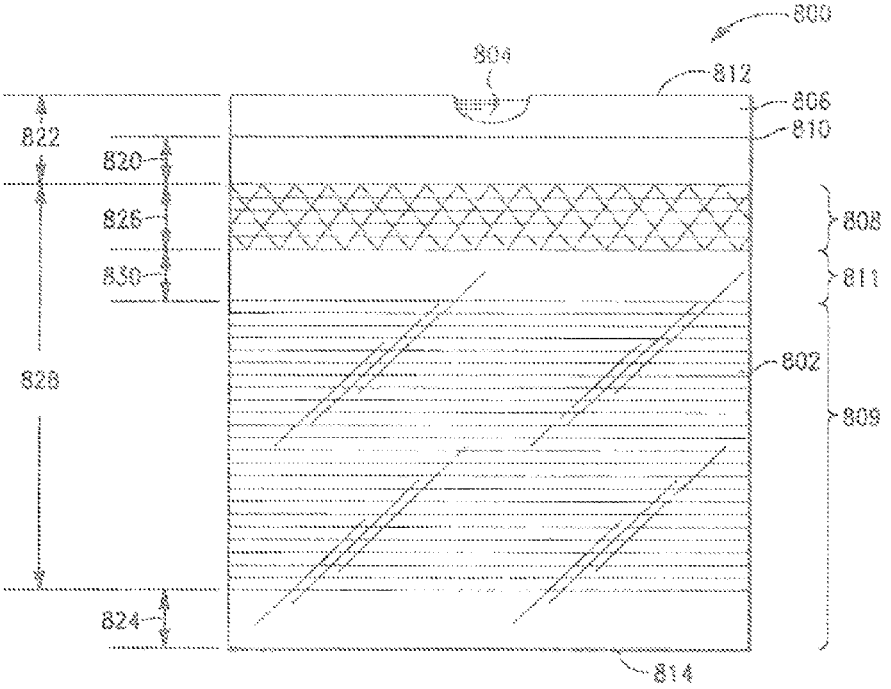
FIG. 15 is a front elevational view of another embodiment of the thermoplastic bag for use as a trash receptacle liner.

Referring now to FIG. 15, there is illustrated another embodiment of a bag 800 for use as a trash receptacle liner. The bag 800 may include a first sidewall 802 of thermoplastic material, a draw tape 804, a hem 806, a network pattern area 808 and a ribbed patterned area 809. The network patterned area 808 is a distance 820 below the hem seal 810 and a distance 822 below the bag top 812. The network patterned area 808 is separated from the ribbed patterned area 809 by an un-patterned area 811. The un-patterned area 811 extends a distance 830 from top to bottom. The ribbed patterned area 809 does not reach to the bag bottom 814 but is a distance 824 from the bag bottom 814. The network patterned area 808 extends a distance 826 from top to bottom and typically extends across the entire width of the bag. The ribbed patterned area 809 extends a distance 828 from top to bottom and typically extends across the entire width of the bag. The distance 822 can have a first range of about 1.0 inches to 8.0 inches, a second range of about 1.5 inches to 4.0 inches, and a third range of about 2.0 inches to 3.0 inches. In one embodiment, the distance 822 may be about 2.5 inches. The distance 820 can have a first range of 0.25 inches to 7.0 inches, a second range of 0.25 inches to 4.0 inches, a third range of 0.5 inches to 2.0 inches. In one embodiment, the distance 820 may be about 1.0 inches. The distance 826 can have a first range of 0.25 inches to 12.0 inches, a second range of 0.5 inches to 8.0 inches, a third range of 0.5 inches to 4.0 inches. In one embodiment, the distance 826 may be about 4.0 inches. The distance 824 can have a first range of 0.25 inches to 12.0 inches, a second range of 0.5 inches to 8.0 inches, a third range of 0.5 inches to 4.0 inches. In one embodiment, the distance 824 may be about 4.0 inches. The distance 828 can have a first range of 10.0 inches to 22.0 inches, a second range of 12.0 inches to 21.0 inches, a third range of 14.0 inches to 20.0 inches. In one embodiment, the distance 828 may be about 21.0 inches. The distance 830 can have a first range of 0.25 inches to 7.0 inches, a second range of 0.25 inches to 4.0 inches, a third range of 0.5 inches to 2.0 inches. In one embodiment, the distance 830 may be about 1.0 inches.

Figure 16:
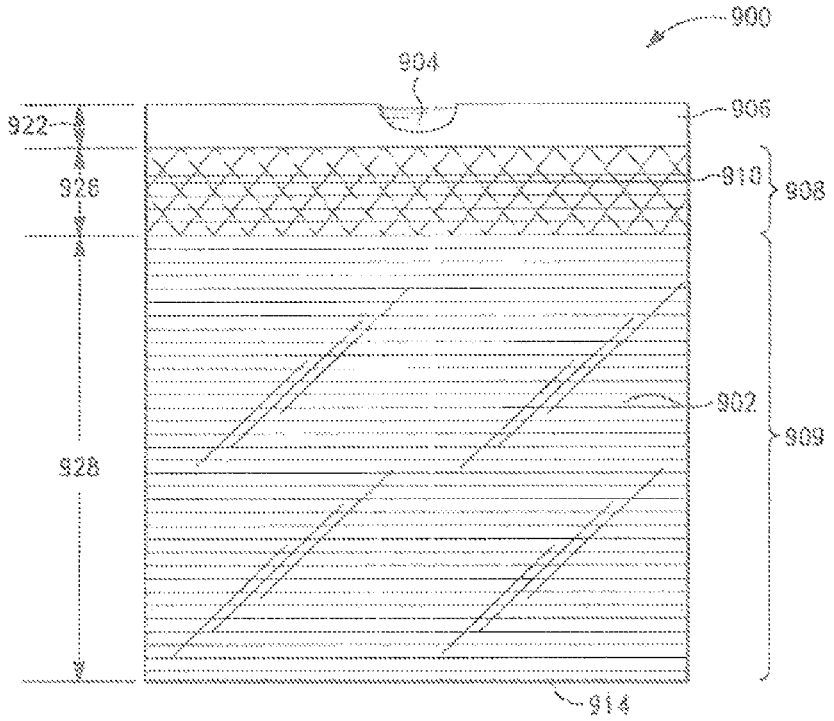
FIG. 16 is a front elevational view of another embodiment of the thermoplastic bag for use as a trash receptacle liner.

Referring now to FIG. 16, there is illustrated another embodiment of a bag 900 for use as a trash receptacle liner. The bag 900 may include a first sidewall 902 of thermoplastic material, a draw tape 904, a hem 906, a network pattern area 908 and a ribbed patterned area 909. The network patterned area 908 slightly overlaps the hem seal 910 and is a distance 922 below the bag top 912. The network patterned area 908 borders the ribbed patterned area 909. The ribbed patterned area 909 reaches to the bag bottom 914. The network patterned area 908 extends a distance 926 from top to bottom and typically extends across the entire width of the bag. The ribbed patterned area 909 extends a distance 928 from top to bottom and typically extends across the entire width of the bag. The distance 922 can have a first range of about 0.5 inches to 4.0 inches, a second range of about 1.0 inches to 3.0 inches, and a third range of about 1.5 inches to 2.5 inches. In one embodiment, the distance 922 may be about 2.0 inches. The distance 926 can have a first range of 0.25 inches to 12.0 inches, a second range of 0.5 inches to 8.0 inches, a third range of 0.5 inches to 4.0 inches. In one embodiment, the distance 926 may be about 4.0 inches. The distance 928 can have a first range of 10.0 inches to 22.0 inches, a second range of 12.0 inches to 21.0 inches, a third range of 14.0 inches to 20.0 inches. In one embodiment, the distance 928 may be about 21.0 inches.

Figure 17:
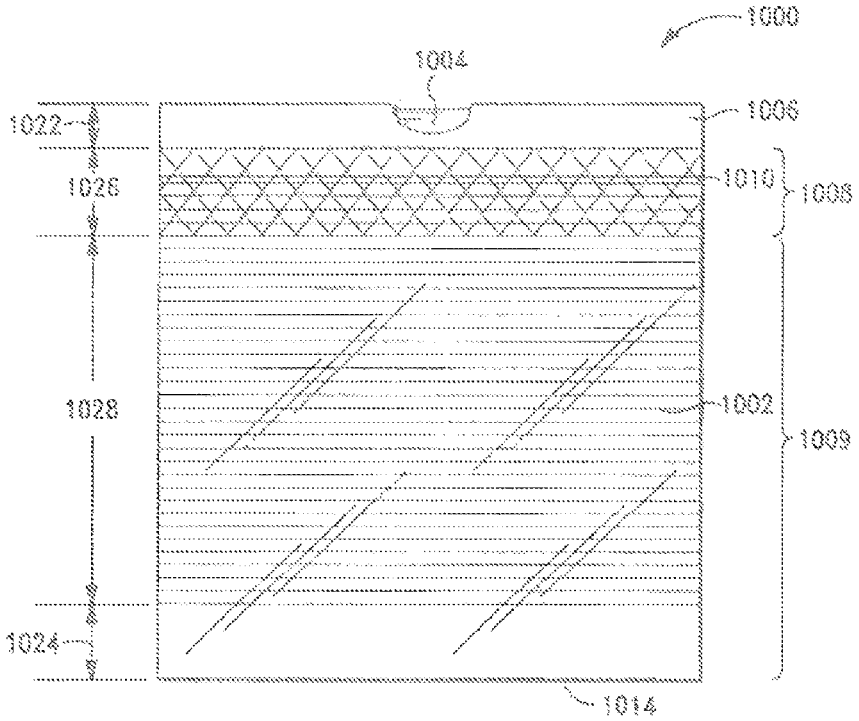
FIG. 17 is a front elevational view of another embodiment of the thermoplastic bag for use as a trash receptacle liner.

Referring now to FIG. 17, there is illustrated another embodiment of a bag 1000 for use as a trash receptacle liner. The bag 1000 may include a first sidewall 1002 of thermoplastic material, a draw tape 1004, a hem 1006, a network pattern area 1008 and a ribbed patterned area 1009. The network patterned area 1008 slightly overlaps the hem seal 910 and is a distance 1022 below the bag top 1012. The network patterned area 1008 borders the ribbed patterned area 1009. The ribbed patterned area 1009 does not reach to the bag bottom 1014 but is a distance 1024 from the bag bottom 1014. The network patterned area 1008 extends a distance 1026 from top to bottom and typically extends across the entire width of the bag. The ribbed patterned area 1009 extends a distance 1028 from top to bottom and typically extends across the entire width of the bag. The distance 1022 can have a first range of about 0.5 inches to 4.0 inches, a second range of about 1.0 inches to 3.0 inches, and a third range of about 1.5 inches to 2.5 inches. In one embodiment, the distance 1022 may be about 2.0 inches. The distance 1026 can have a first range of 0.25 inches to 12.0 inches, a second range of 0.5 inches to 8.0 inches, a third range of 0.5 inches to 4.0 inches. In one embodiment, the distance 1026 may be about 4.0 inches. The distance 1024 can have a first range of 0.25 inches to 12.0 inches, a second range of 0.5 inches to 8.0 inches, a third range of 0.5 inches to 4.0 inches. In one embodiment, the distance 1024 may be about 4.0 inches. The distance 1028 can have a first range of 10.0 inches to 22.0 inches, a second range of 12.0 inches to 21.0 inches, a third range of 14.0 inches to 20.0 inches. In one embodiment, the distance 1028 may be about 21.0 inches.

A network pattern may be formed in a variety of ways, for example forming a strainable network, embossing or printing. The network patterned area may exhibit a variety of functional properties. The network pattern area may be continuous across the width of the bag or discontinuous across the width of the bag. Though not bound by theory, the continuous network pattern may have advantages, for example gripping, over an un-patterned area. Though not bound by theory, the discontinuous network pattern may have advantages, for example strength, over an un-patterned area.

Figure 18:
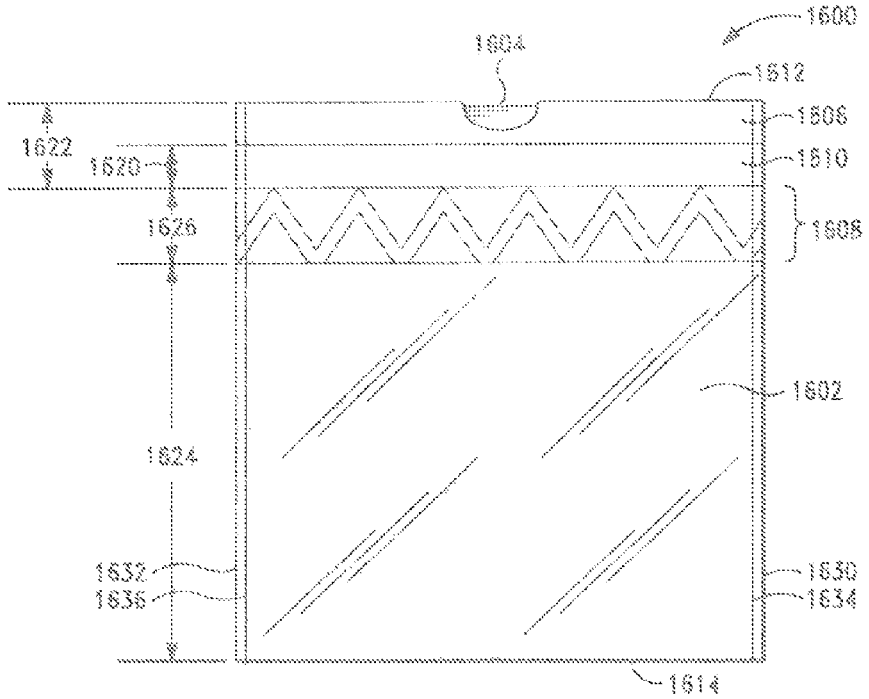
FIG. 18 is a front elevational view of another embodiment of the thermoplastic bag for use as a trash receptacle liner.

Referring now to FIG. 18, there is illustrated another embodiment of a bag 1600 for use as a trash receptacle liner. The bag 1600 may include a first sidewall 1602 of thermoplastic material, a draw tape 1604, a hem 1606, and a continuous network pattern area 1608. The continuous network pattern area 1608 is a distance 1620 below the hem seal 1610 and a distance 1622 below the bag top 1612. The continuous network patterned area 1608 does not reach to the bag bottom 1614 but is a distance 1624 from the bag bottom 1614. The continuous network patterned area 1608 extends a distance 1626 from top to bottom and typically extends across the entire width of the bag. Although the continuous network patterned area 1608 may result in greater loft to the film, the average thickness does not appreciably change compared to the un-patterned area. In one example, there is a consistent film thickness of about 0.95 mil from the bag top 1612 to the bag bottom 1614, noting that the bag top 1612 may have two film layers each having a consistent film thickness. The continuous network pattern area 1608 forms a pattern with icons extending continuously between the first side edge 1630 and the second side edge 1632. The network pattern 1608 may also extend across the first sidewall seam 1634 and second sidewall seam 1636.

The distance 1622 can have a first range of about 1.0 inches to 8.0 inches, a second range of about 1.5 inches to 4.0 inches, and a third range of about 2.0 inches to 3.0 inches. In one embodiment, the distance 1622 may be about 2.5 inches. The distance 1620 can have a first range of 0.25 inches to 7.0 inches, a second range of 0.25 inches to 4.0 inches, a third range of 0.5 inches to 2.0 inches. In one embodiment, the distance 1620 may be about 1.0 inches.

The distance 1624 can have a first range of 0.25 inches to 24.0 inches, a second range of 4.0 inches to 22.0 inches, a third range of 10.0 inches to 21.0 inches. In one embodiment, the distance 1620 may be about 20.0 inches. The distance 1626 can have a first range of 1.0 inches to 7.0 inches, a second range of 1.0 inches to 4.0 inches, a third range of 1.0 inches to 2.0 inches. In one embodiment, the distance 1626 may be about 1.5 inches.

Figure 19:
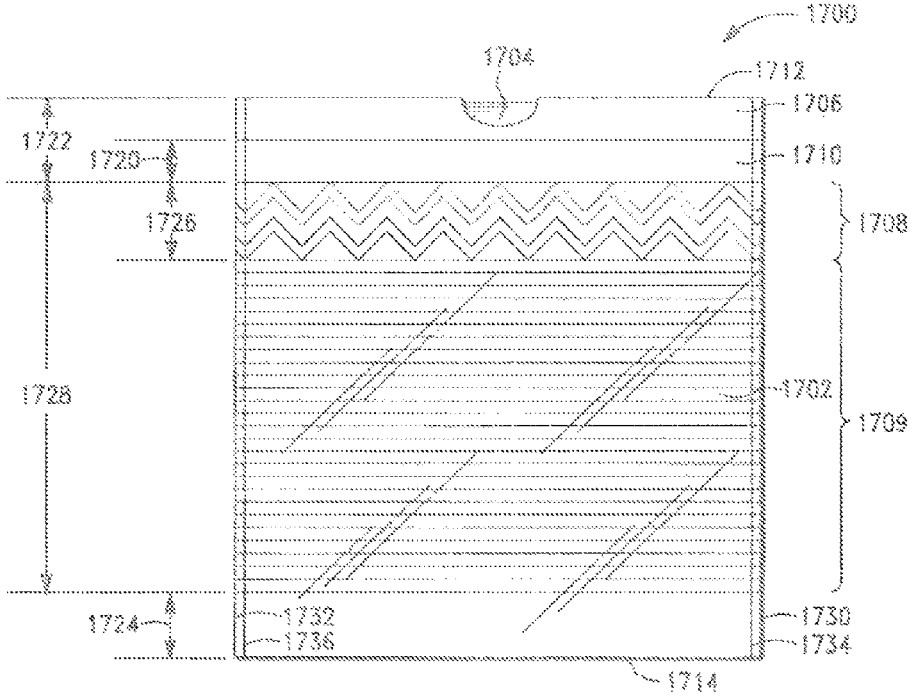
FIG. 19 is a front elevational view of another embodiment of the thermoplastic bag for use as a trash receptacle liner.

Referring now to FIG. 19, there is illustrated another embodiment of a bag 1700 for use as a trash receptacle liner. The bag 1000 may include a first sidewall 1702 of thermoplastic material, a draw tape 1704, a hem 1706, a continuous network pattern area 1708 and a ribbed patterned area 1709. The continuous network patterned area 1708 is a distance 1720 below the hem seal 1710 and a distance 1722 below the bag top 1712. The network patterned area 1708 borders the ribbed patterned area 1709. The ribbed patterned area 1709 does not reach to the bag bottom 1714 but is a distance 1724 from the bag bottom 1714. The continuous network pattern area 1708 forms a pattern with icons extending continuously between the first side edge 1730 and the second side edge 1732. The network pattern 1708 may also extend across the first sidewall seam 1734 and second sidewall seam 1736.

The network patterned area 1708 extends a distance 1726 from top to bottom and typically extends across the entire width of the bag. The ribbed patterned area 1709 extends a distance 1728 from top to bottom and typically extends across the entire width of the bag. The distance 1722 can have a first range of about 1.0 inches to 8.0 inches, a second range of about 1.5 inches to 4.0 inches, and a third range of about 2.0 inches to 3.0 inches. In one embodiment, the distance 1722 may be about 2.5 inches. The distance 1720 can have a first range of 0.25 inches to 7.0 inches, a second range of 0.25 inches to 4.0 inches, a third range of 0.5 inches to 2.0 inches. In one embodiment, the distance 1720 may be about 1.0 inches. The distance 1724 can have a first range of 0.25 inches to 12.0 inches, a second range of 0.5 inches to 8.0 inches, a third range of 0.5 inches to 4.0 inches. In one embodiment, the distance 1724 may be about 4.0 inches. The distance 1726 can have a first range of 0.25 inches to 12.0 inches, a second range of 0.5 inches to 8.0 inches, a third range of 0.5 inches to 4.0 inches. In one embodiment, the distance 1726 may be about 4.0 inches. The distance 1728 can have a first range of 10.0 inches to 22.0 inches, a second range of 12.0 inches to 21.0 inches, a third range of 14.0 inches to 20.0 inches. In one embodiment, the distance 1728 may be about 21.0 inches.

Figure 20:
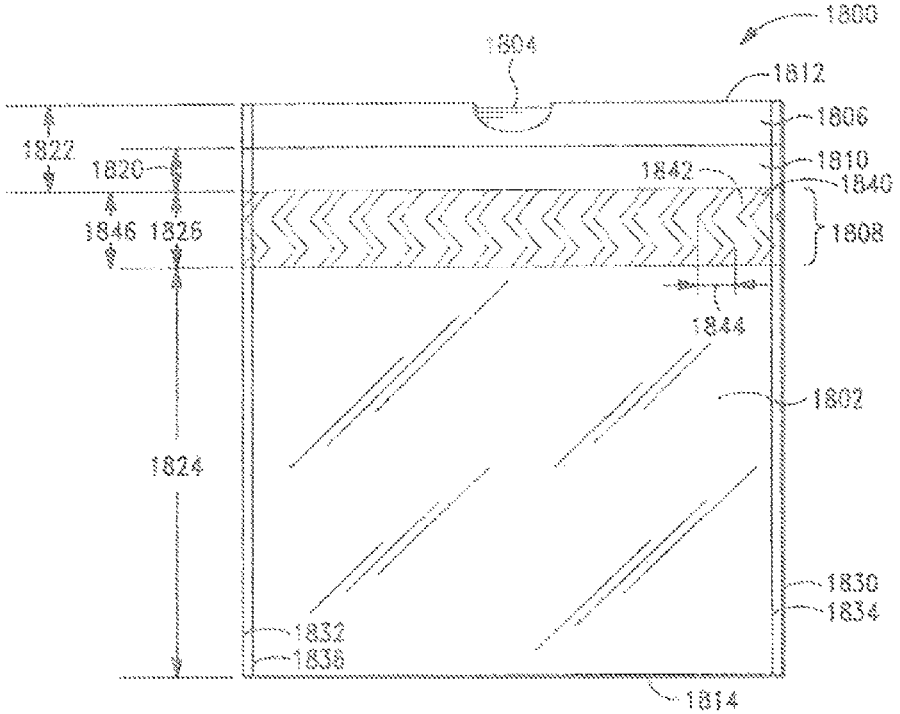
FIG. 20 is a front elevational view of another embodiment of the thermoplastic bag for use as a trash receptacle liner.

Referring now to FIG. 20, there is illustrated another embodiment of a bag 1800 for use as a trash receptacle liner. The bag 1800 may include a first sidewall 1802 of thermoplastic material, a draw tape 1804, a hem 1806, and a discontinuous network pattern area 1808. The discontinuous network pattern area 1808 forms a pattern with icons 1840 interrupted by smooth, unmarked, or unraised areas 1842 as the discontinuous network pattern area 1808 extends discontinuously between the first side edge 1830 and the second side edge 1832. The discontinuous network pattern area 1808 has icons 1840 with a maximum icon length 1844 measured in the direction across the width of the bag between the sidewalls and a maximum icon height 1846 measured in the direction across the height of the bag from the bag bottom 1814 to the bag top 1812.

The discontinuous network pattern area 1808 is a distance 1820 below the hem seal 1810 and a distance 1822 below the bag top 1812. The discontinuous network patterned area 1808 does not reach to the bag bottom 1814 but is a distance 1824 from the bag bottom 1814. The discontinuous network patterned area 1808 extends a distance 1826 from top to bottom and typically extends across the entire width of the bag. Although the discontinuous network patterned area 1808 may result in greater loft to the film, the average thickness does not appreciably change compared to the un-patterned area. In one example, there is a consistent film thickness of about 0.95 mil from the bag top 1812 to the bag bottom 1814, noting that the bag top 1812 may have two film layers each having a consistent film thickness. The discontinuous network pattern area 1808 forms a pattern with icons extending discontinuously between the first side edge 1830 and the second side edge 1832. The network pattern 1808 may also extend across the first sidewall seam 1834 and second sidewall seam 1836.

The distance 1822 can have a first range of about 1.0 inches to 8.0 inches, a second range of about 1.5 inches to 4.0 inches, and a third range of about 2.0 inches to 3.0 inches. In one embodiment, the distance 1822 may be about 2.5 inches. The distance 1820 can have a first range of 0.25 inches to 7.0 inches, a second range of 0.25 inches to 4.0 inches, a third range of 0.5 inches to 2.0 inches. In one embodiment, the distance 1820 may be about 1.0 inches. The distance 1824 can have a first range of 0.25 inches to 24.0 inches, a second range of 4.0 inches to 22.0 inches, a third range of 10.0 inches to 21.0 inches. In one embodiment, the distance 1820 may be about 20.0 inches. The distance 1826 can have a first range of 1.0 inches to 7.0 inches, a second range of 1.0 inches to 4.0 inches, a third range of 1.0 inches to 2.0 inches. In one embodiment, the distance 1826 may be about 1.5 inches.

Figure 21:
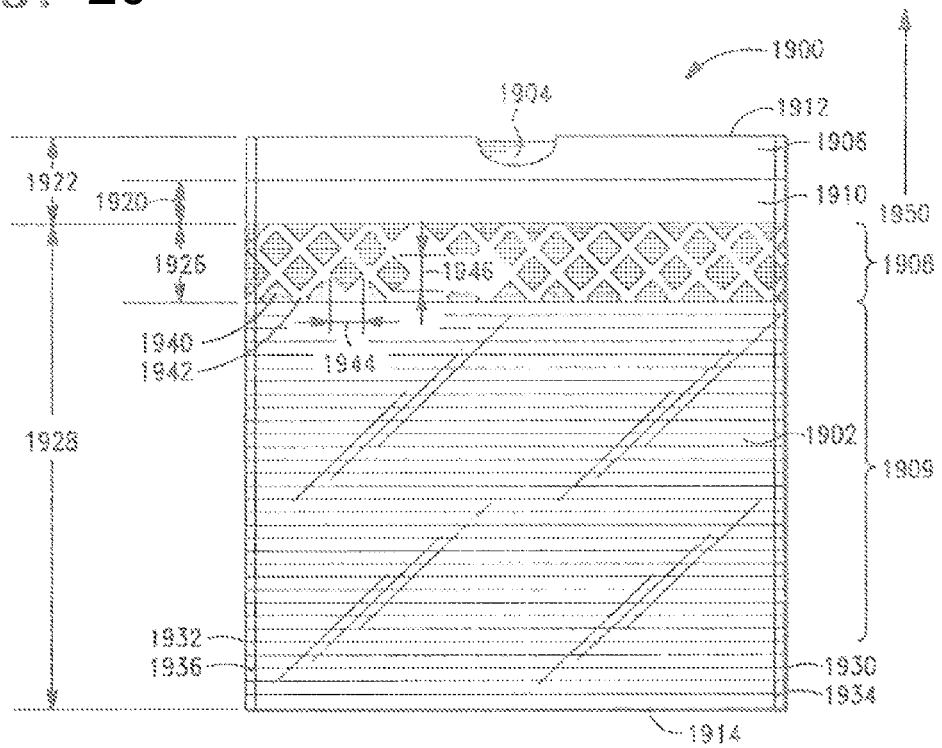
FIG. 21 is a front elevational view of another embodiment of the thermoplastic bag for use as a trash receptacle liner.

Referring now to FIG. 21, there is illustrated another embodiment of a bag 1900 for use as a trash receptacle liner. The bag 1900 may include a first sidewall 1902 of thermoplastic material, a draw tape 1904, a hem 1906, a discontinuous network pattern area 1908 and a ribbed patterned area 1909. The discontinuous network patterned area 1908 is a distance 1920 below the hem seal 1910 and a distance 1922 below the bag top 1912. The discontinuous network pattern area 1908 forms a pattern with icons 1940 interrupted by smooth, unmarked, or unraised areas 1942 as the discontinuous network pattern area 1908 extends discontinuously between the first side edge 1930 and the second side edge 1932. The discontinuous network pattern area 1908 has icons 1940 with a maximum icon length 1944 measured in the direction across the width of the bag between the sidewalls and a maximum icon height 1946 measured in the direction across the height of the bag from the bag bottom 1914 to the bag top 1912.

The network patterned area 1908 borders the ribbed patterned area 1909. The ribbed patterned area 1909 reaches to the bag bottom 1914. The discontinuous network pattern area 1908 forms a pattern with icons extending discontinuously between the first side edge 1930 and the second side edge 1932. The network pattern 1908 may also extend across the first sidewall seam 1934 and second sidewall seam 1936.

The network patterned area 1908 extends a distance 1926 from top to bottom and typically extends across the entire width of the bag. The ribbed patterned area 1909 extends a distance 1928 from top to bottom and typically extends across the entire width of the bag. The distance 1922 can have a first range of about 1.0 inches to 8.0 inches, a second range of about 1.5 inches to 4.0 inches, and a third range of about 2.0 inches to 3.0 inches. In one embodiment, the distance 1922 may be about 2.5 inches. The distance 1920 can have a first range of 0.25 inches to 7.0 inches, a second range of 0.25 inches to 4.0 inches, a third range of 0.5 inches to 2.0 inches. In one embodiment, the distance 1720 may be about 1.0 inches. The distance 1924 can have a first range of 0.25 inches to 12.0 inches, a second range of 0.5 inches to 8.0 inches, a third range of 0.5 inches to 4.0 inches. In one embodiment, the distance 1924 may be about 4.0 inches. The distance 1926 can have a first range of 0.25 inches to 12.0 inches, a second range of 0.5 inches to 8.0 inches, a third range of 0.5 inches to 4.0 inches. In one embodiment, the distance 1926 may be about 4.0 inches. The distance 1928 can have a first range of 10.0 inches to 22.0 inches, a second range of 12.0 inches to 21.0 inches, a third range of 14.0 inches to 20.0 inches. In one embodiment, the distance 1928 may be about 21.0 inches.

One example of a discontinuous network patterned area is the discontinuous, strainable network patterned area described in U.S. Pat. App. 2008/0137995 to Fraser et al. and incorporated by reference in its entirety herein. A process for a discontinuous network pattern is also described with reference to FIGS. 10 and 11. The sheet material of the network patterned area comprises a first region and a second region. The first region and said second region are comprised of the same material composition and each has an un-tensioned projected path length. The first region undergoes a substantially molecular-level deformation and the second region initially undergoes a substantially geometric deformation when the sheet material is subjected to an applied elongation in a direction substantially parallel to an axis in response to an externally-applied force upon the sheet material of the network patterned area. A band of such sheet material could be provided in one region of the bag forming a complete circular band around the bag body to provide a more localized stretch property.

Another suitable example of a discontinuous network pattern area is described in U.S. Pat. No. 5,518,801 to Chappell et al., incorporated in its entirety by reference herein. As shown in FIG. 21, the discontinuous strainable network pattern has at least two distinct and dissimilar regions, corresponding to an icon consisting of a strainable network region of substantially parallel rib-like elements and a smooth region between the icons of strainable network regions. The strainable network regions initially undergo a substantially geometric deformation in response to an applied strain in a direction substantially parallel to the axis.

In a suitable embodiment, the strainable network region is comprised of a plurality of raised rib-like elements. As used herein, the term "rib-like element" refers to an embossment, debossment or combination thereof which has a major axis and a minor axis. Preferably, the major axis is at least as long as the minor axis. The major axes of the rib-like elements are preferably oriented substantially perpendicular to the axis of applied strain. The major axis and the minor axis of the rib-like elements may each be linear, curvilinear or a combination of linear and curvilinear. In the case of a curvilinear element it may be more convenient to use a linear axis which represents an average of the curvilinear element. In the case of a draw tape bag, the axis of applied strain 1950 results from lifting the bag at the hem so that the axis goes from the bottom to the top of the bag.

The rib-like elements allow the strainable network region to undergo a substantially "geometric deformation" which results in significantly less resistive forces to an applied strain than that exhibited by the "molecular-level deformation" of the smooth region. As used herein, the term "molecular-level deformation" refers to deformation which occurs on a molecular level and is not discernible to the normal naked eye. That is, even though one may be able to discern the effect of molecular-level deformation, e.g., elongation of the smooth region, one is not able to discern the deformation which allows or causes it to happen. This is in contrast to the term "geometric deformation". As used herein the term "geometric deformation" refers to deformations of the discontinuous network film which are generally discernible to the normal naked eye when the discontinuous network film or articles embodying the discontinuous network film are subjected to an applied strain. Types of geometric deformation include, but are not limited to bending, unfolding, and rotating.

The discontinuous strainable network pattern may provide improved properties compared to a continuous smooth film. For example, the discontinuous strainable network pattern may provide improved tear and impact properties. This may especially be true when the discontinuous strainable network pattern is separated from the hem by a smooth region. Having a either a smooth area or a continuous ribbed area below the discontinuous network pattern may also improve the bag properties.

Additional examples of a network patterned area having lower surface contact would be an embossed network patterned area below the hem. The method of embossing the film of the present invention can involve calendar embossing the film with discrete "icons" to form raised icons extending beyond the plane of the film, each icon having an icon length and separated from adjacent icons by a non-raised portion. By "icon" as used herein is meant a single, discrete, design or shape, such as a heart, square, triangle, diamond, trapezoid, circle, polygon formed essentially as a line drawing. While certain icons may have portions not describable as a "line" (such as eyes of animals, etc.), the overall design comprises primarily lines in a pattern to make the design or shape. In one example in FIG. 20, the embossed icons are circles. In suitable examples, the raised icon area is larger than the non-raised area around the icons. Where the icons are printed, instead of embossed, the icons are not raised from the plane of the film but are separated from each other by the absence of lines. The icon area can represent greater than 10%, or greater than 50%, or greater than 60%, or greater than 70%, or greater than 80% of the total network patterned area. The film may be embossed with a pattern that provides texture to the film, but with no additional overall stretching. The film may be embossed by feeding between two rolls, one or both of which have an embossing pattern. The rolls may be heated or unheated.

The film may be coated or printed with an ink to form a network pattern. Depending upon the composition, various coating and printing process may be appropriate. For instance, in addition to ink jet printing and other non-impact printers, the composition can be used in screen printing processes, offset lithographic processes, flexographic printing processes, rotogravure printing processes, and the like. In other cases, a coating process may be appropriate. In the gravure coating process, an engraved roller runs in coating bath which fills the engraved recesses in engraved roller with excess additive delivery slurry. The excess slurry on engraved roller is wiped off engraved roller by doctor blade, with engraved roller thereafter depositing additive delivery slurry layer onto substrate film as substrate film passes between engraved roller and pressure roller.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Exemplary embodiments are described herein. Variations of those embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A thermoplastic bag comprising:

a first sidewall of flexible thermoplastic material;

a second sidewall of flexible thermoplastic material overlaying and joined to the first sidewall to form a first sidewall seam along a first side edge, to form a second sidewall seam along an opposite second side edge, and a closed bottom edge, the first and second sidewalls un-joined along respective top edges to define an opening opposite the bottom edge for accessing the interior volume;

at least one of the sidewalls forming a hem having a top length and extending along the open top end disposed opposite the bottom edge, the hem having a bottom length and a hem seal, the hem including one or more draw tape notches and a draw tape within the hem;

wherein at least one of the first or second sidewalls includes a first portion with a pattern of adjacent, linear ribs extending linearly between the first side edge and the second side edge, the ribs being parallel and separated by stretched thinner sections, the ribs alternating between first ribs and second ribs, wherein:

each side of each of the first ribs have a sharp, hour glass transition from top and bottom surfaces of the first ribs to the stretched thinner sections and a first average width; and each side of each of the second ribs having a smooth gradual transition from the top and bottom surfaces of the second ribs to the stretched thinner sections and a second width, the second average width, the second average width differing from the first average width.

2. The thermoplastic bag of claim 1, wherein the bag has a bottom un-patterned portion adjacent to the bottom edge.

3. The thermoplastic bag of claim 1, wherein the first average width of the first ribs having the sharp, hour glass transition is greater than the second average width of the second ribs having the smooth gradual transition.

4. The thermoplastic bag of claim 1, wherein the smooth gradual transition of the second ribs is not symmetrical across a cross-section of the smooth gradual transition.

5. The thermoplastic bag of claim 1, wherein the sharp, hour glass transition of the first ribs is relatively symmetrical across a cross-section of the sharp, hour glass transition.

6. The thermoplastic bag of claim 1, wherein the bag has a second portion of discontinuous network pattern ribs above the first portion of the pattern of adjacent, linear ribs.

7. The thermoplastic bag of claim 6, wherein the second portion is below the hem seal.

8. The thermoplastic bag of claim 6, wherein the second portion is immediately adjacent to the first portion.

9. The thermoplastic bag of claim 6, wherein the second portion is a strainable network comprising a first region undergoing substantially molecular-level deformation and a second region undergoing substantially geometric deformation.

10. The thermoplastic bag of claim 6, wherein the second portion is a discontinuous network pattern comprising strainable network elements of substantially parallel ribs and smooth, non-raised regions between the strainable network elements.

11. A thermoplastic bag comprising:

a first sidewall of flexible thermoplastic material;

a second sidewall of flexible thermoplastic material overlaying and joined to the first sidewall to form a first sidewall seam along a first side edge, to form a second sidewall seam along an opposite second side edge, and a closed bottom edge, the first and second sidewalls un-joined along respective top edges to define an opening opposite the bottom edge for accessing the interior volume;

wherein at least one of the first or second sidewalls includes a portion with a pattern of adjacent, linear ribs extending linearly between the first side edge and the second side edge, the ribs being parallel and separated by stretched thinner sections, wherein:

the pattern of adjacent, linear ribs comprises a first set of ribs with a first cross-sectional shape and a second set of ribs with a second cross-sectional shape, the first cross-sectional shape differing from the second cross-sectional shape in one or more of width or transitional shape between the rib and the stretched thinner sections;

the ribs of the second set of ribs are formed by passing at least one of the first or second sidewalls through a pair of intermeshing rollers each having ridges with circular ends; and ribs of the first set of ribs alternate with ribs of the second set of ribs.

12. The thermoplastic bag of claim 11, wherein the bag has a bottom un-patterned portion adjacent to the bottom edge.

13. The thermoplastic bag of claim 11, wherein ribs of the first set of ribs have a width that is greater than a width of the ribs of the second set of the second set of ribs.

14. The thermoplastic bag of claim 13, wherein:

a transition of the ribs of the second set of ribs to the stretched thinner sections is not symmetrical across a cross-section of the ribs of the second set of ribs; and a transition of the ribs of the first set of ribs to the stretched thinner sections is relatively symmetrical across a cross-section of the ribs of the first set of ribs.

15. The thermoplastic bag of claim 11, wherein the bag has a second portion of discontinuous network pattern ribs above the first portion of the pattern of adjacent, linear ribs.

16. The thermoplastic bag of claim 15, wherein the second portion is a strainable network comprising a first region undergoing substantially molecular-level deformation and a second region undergoing substantially geometric deformation.

17. A thermoplastic film, wherein the film has a pattern of adjacent, linear ribs extending linearly between a first side edge and a second side edge, the ribs being parallel and separated by stretched thinner sections, the ribs alternating between first ribs and second ribs, wherein:

the first ribs have a sharp, hour glass transition from top and bottom surfaces of the first ribs to the stretched thinner sections and a first average width, the sharp, hour glass transitions being a result of passing through a pair intermeshing rollers each having ridges with circular ends; and the second ribs having a smooth gradual transition from the top and bottom surfaces of the second ribs to the stretched thinner sections and a second width, the second average width, the second average width differing from the first average width.

18. The thermoplastic film of claim 17, wherein:

the smooth gradual transition of the second ribs to the thinner sections is not symmetrical across a cross-section of the second ribs; and the sharp, hour glass transition of the first ribs is relatively symmetrical across a cross-section of the first ribs.

19. The thermoplastic film of claim 18, wherein the first average width length of the first ribs having a the sharp, hour glass transition is greater longer than the second average width length of the second ribs having the smooth gradual transition.

* * * * *